US012788152B2

(12) United States Patent
Krob et al.

(10) Patent No.: US 12,788,152 B2
(45) Date of Patent: Nov. 10, 2026

(54) CHAIR INCLUDING PLURALITY OF SHAFT PORTIONS

(71) Applicants: B4K GmbH, Wolfhalden (CH); Joachim Brueske, Berlin (DE); OKAMURA CORPORATION, Yokohama (JP)

(72) Inventors: Andreas Krob, Wolfhalden (CH); Joachim Brueske, Berlin (DE); Youichirou Oda, Yokohama (JP)

(73) Assignees: OKAMURA CORPORATION, Kanagawa (JP); B4K GMBH, Wolfhalden (CH); Joachim Brueske, Berlin (DE)

( * ) Notice: Subject to any disclaimer, the term of this patent is extended or adjusted under 35 U.S.C. 154(b) by 0 days.

(21) Appl. No.: 19/124,602

(22) PCT Filed: Oct. 31, 2022

(86) PCT No.: PCT/JP2022/040834
§ 371 (c)(1),
(2) Date: Apr. 25, 2025

(87) PCT Pub. No.: WO2024/095353
PCT Pub. Date: May 10, 2024

(65) Prior Publication Data

US 2026/0007239 A1 Jan. 8, 2026

(51) Int. Cl.

| | |
|---|---|
| *A47C 7/44* | (2006.01) |
| *A47C 3/30* | (2006.01) |
| *A47C 7/00* | (2006.01) |

(52) U.S. Cl.
CPC ..... *A47C 7/44* (2013.01); *A47C 3/30* (2013.01); *A47C 7/004* (2013.01); *A47C 7/006* (2013.01)

(58) Field of Classification Search
CPC ..... A47C 7/44; A47C 7/004; A47C 7/006; A47C 3/30
USPC ..... 297/301.5
See application file for complete search history.

(56) References Cited

U.S. PATENT DOCUMENTS

| | | | |
|---|---|---|---|
| 5,224,758 | A | 7/1993 | Takamatsu et al. |
| 5,582,459 | A | 12/1996 | Hama et al. |
| 2005/0121954 | A1 | 6/2005 | Coffield et al. |

(Continued)

FOREIGN PATENT DOCUMENTS

| | | | |
|---|---|---|---|
| CN | 101951812 | A | 1/2011 |
| CN | 102905579 | A | 1/2013 |

(Continued)

OTHER PUBLICATIONS

International Search Report for Application No. PCT/JP2022/040834, mailed Jan. 10, 2023 (4 pages).

(Continued)

*Primary Examiner* — Jose V Chen
(74) *Attorney, Agent, or Firm* — NIXON PEABODY LLP; Jeffrey L. Costellia

(57) ABSTRACT

A chair includes a seat, a backrest, and a support structure supporting the seat and the backrest. The backrest includes an arm portion and a back support portion. The support structure includes a first shaft portion, a second shaft portion, a third shaft portion, a fourth shaft portion, a support base, an arm support portion, and a support link.

8 Claims, 10 Drawing Sheets

(56) References Cited

U.S. PATENT DOCUMENTS

| | | | | |
|---|---|---|---|---|
| 2012/0161483 | A1* | 6/2012 | Hayashi | A47C 1/03255 297/300.2 |
| 2020/0196763 | A1* | 6/2020 | Yajima | A47C 3/0255 |
| 2020/0305610 | A1* | 10/2020 | Bock | A47C 7/58 |
| 2021/0112988 | A1* | 4/2021 | Yajima | A47C 9/002 |
| 2023/0363536 | A1* | 11/2023 | Serena | A47C 3/0255 |
| 2023/0380596 | A1* | 11/2023 | Isogai | A47C 1/03238 |
| 2026/0007239 | A1* | 1/2026 | Krob | A47C 1/03255 |

FOREIGN PATENT DOCUMENTS

| | | | | |
|---|---|---|---|---|
| CN | 204812896 | U | 12/2015 | |
| EP | 2769642 | A1 | 8/2014 | |
| EP | 3708033 | A1 * | 9/2020 | A47C 3/026 |
| JP | 030089647 | U | 9/1991 | |
| JP | 05184432 | A * | 7/1993 | |
| JP | 07155232 | A | 6/1995 | |
| JP | 2004049736 | A | 2/2004 | |
| JP | 2010-094276 | A | 4/2010 | |
| JP | 2010094278 | A * | 4/2010 | |
| JP | 2011193926 | A | 10/2011 | |
| JP | 2013153869 | A | 8/2013 | |
| JP | 2019037383 | A | 3/2019 | |
| WO | WO-2017221310 | A1 * | 12/2017 | A47C 3/0257 |
| WO | WO-2017221311 | A1 * | 12/2017 | A47C 3/0255 |

OTHER PUBLICATIONS

Written Opinion of International Application No. PCT/JP2022/040834, mailed Jan. 10, 2023 (7 pages).

Chinese Office Action in Chinese Patent Application No. 202280101389.1 dated Sep. 2, 2025, with English Translation (12 pages).

Extended European Search Report in European Patent Application No. 22964375.4 dated Mar. 2, 2026, (8 pages).

* cited by examiner

CHAIR INCLUDING PLURALITY OF SHAFT PORTIONS

TECHNICAL FIELD

The present invention relates to a chair.

BACKGROUND ART

Conventionally, as a chair used for an office purpose or the like, a chair having a support structure that moves a seat rearward according to tilting of a backrest is known (see, for example, Patent Document 1).

The support structure disclosed in Patent Document 1 includes an arm portion constituting a part of the backrest, a support link, and four shafts positioned below the seat. The seat is connected via a rail to two shafts positioned on an upper side among the four shafts. The support link is supported by two shafts positioned at the front among the four shafts. The arm portion of the backrest is supported by two shafts positioned at the rear among the four shafts. When the backrest is tilted with respect to a vertical direction, the arm portion tilts with respect to a horizontal direction, and the support link tilts to cause the seat to move rearward.

CITATION LIST

Patent Document

Patent Document 1: Japanese Unexamined Patent Application, First Publication No. 2004-049736

SUMMARY OF INVENTION

Technical Problem

However, in the chair described in Patent Document 1, the support structure supporting the support link and the backrest needs to be increased in size in a front-rear direction. As a result, as the support structure increases in size, a space below the seat is occupied by the support structure, leading to a problem in that design quality of the chair is reduced.

The present invention has been made in view of the above-described problems, and an objective of the present invention is to provide a chair that secures a large space below the seat and enhances design quality.

Solution to Problem

A chair according to one aspect of the present invention includes a seat, a backrest tiltable with respect to the seat, and a support structure supporting the seat and the backrest, in which the backrest includes an arm portion supported by the support structure, and a back support portion positioned above the arm portion in a vertical direction and supported by the arm portion, and the support structure includes a first shaft portion extending in a first direction intersecting the vertical direction and rotatably supporting the seat, a second shaft portion positioned behind the first shaft portion in a second direction intersecting the vertical direction and the first direction, extending in the first direction, and rotatably supporting the seat, a third shaft portion positioned below the first shaft portion in the vertical direction, extending in the first direction, and rotatably supporting the arm portion, a fourth shaft portion positioned behind the third shaft portion in the second direction and extending in the first direction, a support base supporting the third shaft portion and the fourth shaft portion, an arm support portion rotatably supported by each of the first shaft portion and the third shaft portion, tiltable with respect to the second direction in conjunction with rotation of the arm portion around the third shaft portion, and supporting the arm portion, and a support link including a first link support portion rotatably supported by the second shaft portion and a second link support portion rotatably supported by the fourth shaft portion, and positioned behind the first shaft portion and the third shaft portion in the second direction.

In such a support structure, the arm support portion and the seat are relatively rotatable around the first shaft portion. The seat and the support link are relatively rotatable around the second shaft portion. The arm support portion and the support base are relatively rotatable around the third shaft portion. The support base and the support link are relatively rotatable around the fourth shaft portion.

In the chair according to the above-described aspect, when an occupant pushes the back support portion toward the rear in the second direction with his/her back in a state in which the occupant is seated on the seat, the arm portion rotates around the third shaft portion in conjunction with movement of the back support portion. As the arm portion rotates, the arm support portion supporting the arm portion also rotates around the third shaft portion. As the arm support portion rotates, the arm support portion supporting the arm portion also rotates around the third shaft portion. The first shaft portion supported by the arm support portion moves rearward in the second direction while rotating around the third shaft portion. The seat supported by the first shaft portion moves rearward in the second direction. As the seat moves, the second shaft portion rotatably supporting the seat also moves rearward in the second direction. The second shaft portion is rotatably supported by the support link. The support link rotates around the fourth shaft portion. That is, the second shaft portion moves rearward in the second direction while rotating around the fourth shaft portion. Therefore, the seat, which is supported by the first shaft portion and the second shaft portion, moves rearward in the second direction along a trajectory that is a combination of rotation around the third shaft portion by the arm support portion and rotation around the fourth shaft portion by the support link. At this time, the support base supporting the third shaft portion and the fourth shaft portion does not move in the second direction. In other words, the seat, the first shaft portion, and the second shaft portion move rearward relative to the support base.

According to the chair of the above-described aspect, when the occupant pushes the back support portion to the rear, the back support portion tilts in the vertical direction, and as the back support portion tilts, the seat can be moved to the rear with respect to the support base, that is, the seat can be directly pulled to the rear.

Furthermore, since the support link is positioned behind the first shaft portion and the third shaft portion in the second direction, there is no need to dispose the support link forward in the second direction. Therefore, the support structure can be made smaller in size, a space at the front in the second direction in a space below the seat can be increased, and a space occupied by the support structure disposed below the seat can be reduced. That is, a large space can be secured below the seat, and design quality of the chair can be enhanced.

Also, the seat is rotatably supported by the second shaft portion that is positioned behind the first shaft portion. The second shaft portion is not directly connected to the backrest but is supported by the support link. Therefore, a state is brought about in which a range of downward movement of the second shaft portion is restricted. In other words, a rotation range of the support link is restricted, and thereby the range of downward movement of the second shaft portion is restricted. Also, since a height of the support link is also restricted, the range of downward movement of the second shaft portion is restricted. In a state in which movement of the second shaft portion is restricted as described above, the second shaft portion is supported to be tiltable rearward and downward. Therefore, tilting of the seat rearward and downward is not affected by the tilting of the backrest. Therefore, when a height of the support link and a rotation range of the support link are appropriately set, it is possible to provide a chair in which an amount of tilt of the support link in the rearward and downward directions of the seat is not excessive.

In the chair according to one aspect of the present invention, the backrest may be tiltable with respect to the seat within a tilt range between a front limit position and a rear limit position in the second direction, and if the backrest is at the front limit position, the support link may stand upright in the vertical direction, or the support link may be inclined with respect to the vertical direction such that the second shaft portion is positioned forward of the fourth shaft portion in the second direction.

According to the chair of the above-described aspect, the support link remains in a state in which it is not tilted rearward when the back support portion is at the front limit position. Therefore, even when the back support portion reaches the rear limit position, an amount of movement of the support link in the rearward and downward directions can be reduced. It is possible to provide a chair in which an amount of tilt of the support link in the rearward and downward directions of the seat is not excessive.

In the chair according to one aspect of the present invention, a first distance between the first shaft portion and the third shaft portion may be greater than a second distance between the second shaft portion and the fourth shaft portion.

According to the chair of the above-described aspect, it is possible to provide a chair in which an amount of tilt of the support link in the rearward and downward directions of the seat is not excessive.

In the chair according to one aspect of the present invention, a position of the second shaft portion may be higher than a position of the third shaft portion in the vertical direction.

According to the chair of the above-described aspect, it is possible to provide a chair in which an amount of tilt of the support link in the rearward and downward directions of the seat is not excessive.

In the chair according to one aspect of the present invention, the seat may have a lower surface in the vertical direction and a recessed portion provided on the lower surface, and the first shaft portion and the second shaft portion may be housed inside the recessed portion.

According to the chair of the above-described aspect, the first shaft portion and the second shaft portion are not exposed to the outside of the recessed portion when viewed from the second direction and the first direction. Therefore, design quality can be enhanced in terms of an appearance of the chair.

In the chair according to one aspect of the present invention, the seat may include a seat main body having the lower surface on which the recessed portion is formed, the support structure may include a seat support member housed inside the recessed portion, the seat support member may support the first shaft portion and the second shaft portion, and the seat support member may overlap the seat main body when viewed in the first direction.

According to the chair of the above-described aspect, when viewed in the second direction and the first direction, the seat support member supporting the first shaft portion and the second shaft portion is not exposed to the outside of the recessed portion. Therefore, design quality can be enhanced in terms of an appearance of the chair. Furthermore, in assembly work of components constituting the chair, the backrest and the seat support member can first be pivotally supported relative to each other, and then work of housing the seat support member in the seat main body can be performed. Therefore, the assembly work can be easily performed.

In the chair according to one aspect of the present invention, the arm support portion may be a support connector attachable to and detachable from the arm portion.

According to the chair of the above-described aspect, the support connector is attachable to and detachable from the arm portion.

In the chair according to one aspect of the present invention, the support connector may include a first connector support portion rotatably supported by the first shaft portion, a second connector support portion rotatably supported by the third shaft portion, and a notch portion provided between the first connector support portion and the second connector support portion and formed in a substantially U shape when viewed in the first direction.

According to the chair of the above-described aspect, a large space can be secured below the seat, and the design quality can be enhanced.

Advantageous Effects of Invention

According to the chair according to the aspect of the present invention, a large space can be secured below the seat, and the design quality can be enhanced.

DESCRIPTION OF EMBODIMENTS

Figure 1:
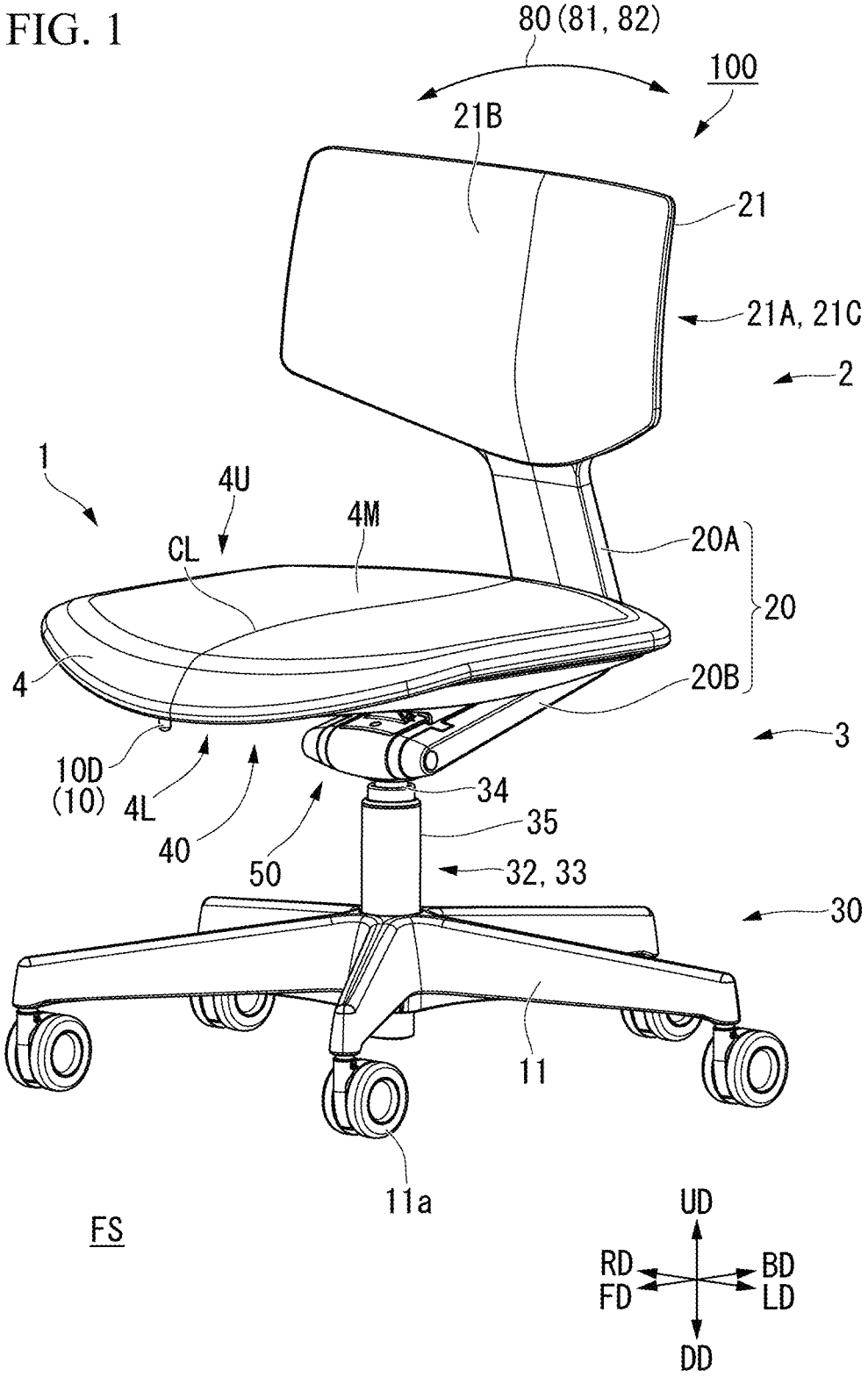
FIG. 1 A perspective view of a chair according to one embodiment of the present invention from obliquely in front.

A chair according to one embodiment of the present invention will be described with reference to the drawings.

In the following description, components having the same or similar functions are denoted by the same reference signs. Also, duplicate description of the components may be omitted. The drawings are schematic or conceptual, and a relationship between a thickness and a width of each portion, a size ratio between portions, and the like are not necessarily the same as actual ones.

In the following description, for convenience of explanation, a direction in which an occupant seated on a seat 1 in a normal posture faces forward is referred to as a "forward direction," and a direction opposite thereto is referred to as a "rearward direction". Also, directions of upward, downward, leftward, and rightward in the following description correspond to directions centered on the occupant when the occupant is seated on the seat 1 in a normal posture. Furthermore, an arrow FD indicating a forward direction, an arrow BD indicating a rearward direction, an arrow UD indicating an upward direction, an arrow DD indicating a downward direction, an arrow RD indicating a rightward direction, and an arrow LD indicating a leftward direction are shown in the drawings.

The upward direction UD and the downward direction DD coincide with a vertical direction (direction of gravity).

The downward direction DD may simply be referred to as a "plan view". The upward direction UD and the downward direction DD may be referred to as vertical directions UD and DD.

Each of the forward direction FD and the rearward direction BD corresponds to a second direction intersecting the vertical direction. Each of the forward direction FD and the rearward direction BD may be a direction parallel to a horizontal plane, or may be an inclined direction inclined with respect to the horizontal plane. The forward direction FD and the rearward direction BD may be referred to as front-rear directions FD and BD. Here, the "horizontal plane" refers to a plane orthogonal to the vertical direction.

Each of the rightward direction RD and the leftward direction LD corresponds to a first direction intersecting the vertical direction and the second direction. That is, the rightward direction RD and the leftward direction LD are directions intersecting the vertical direction and the front-rear directions FD and BD. The rightward direction RD or the leftward direction LD may simply be referred to as a "side view". The rightward direction RD and the leftward direction LD may be referred to as left-right directions RD and LD.

Also, a plane parallel to the front-rear directions FD and BD and the left-right directions RD and LD may be referred to as a "horizontal direction" or "horizontal plane".

<Chair 100>

As shown in FIG. 1, a chair 100 according to the present embodiment includes the seat 1, a backrest 2, an elastic member 23, and a support structure 3. The chair 100 is used in a state in which the chair 100 is placed on a floor surface FS and in a state in which the occupant is seated on the seat 1.

The backrest 2 is connected to the seat 1 via the support structure 3 to be operable in conjunction therewith. In other words, in a structure of the chair 100, the backrest 2 is not directly supported by the seat 1.

<Seat 1>

Figure 2:
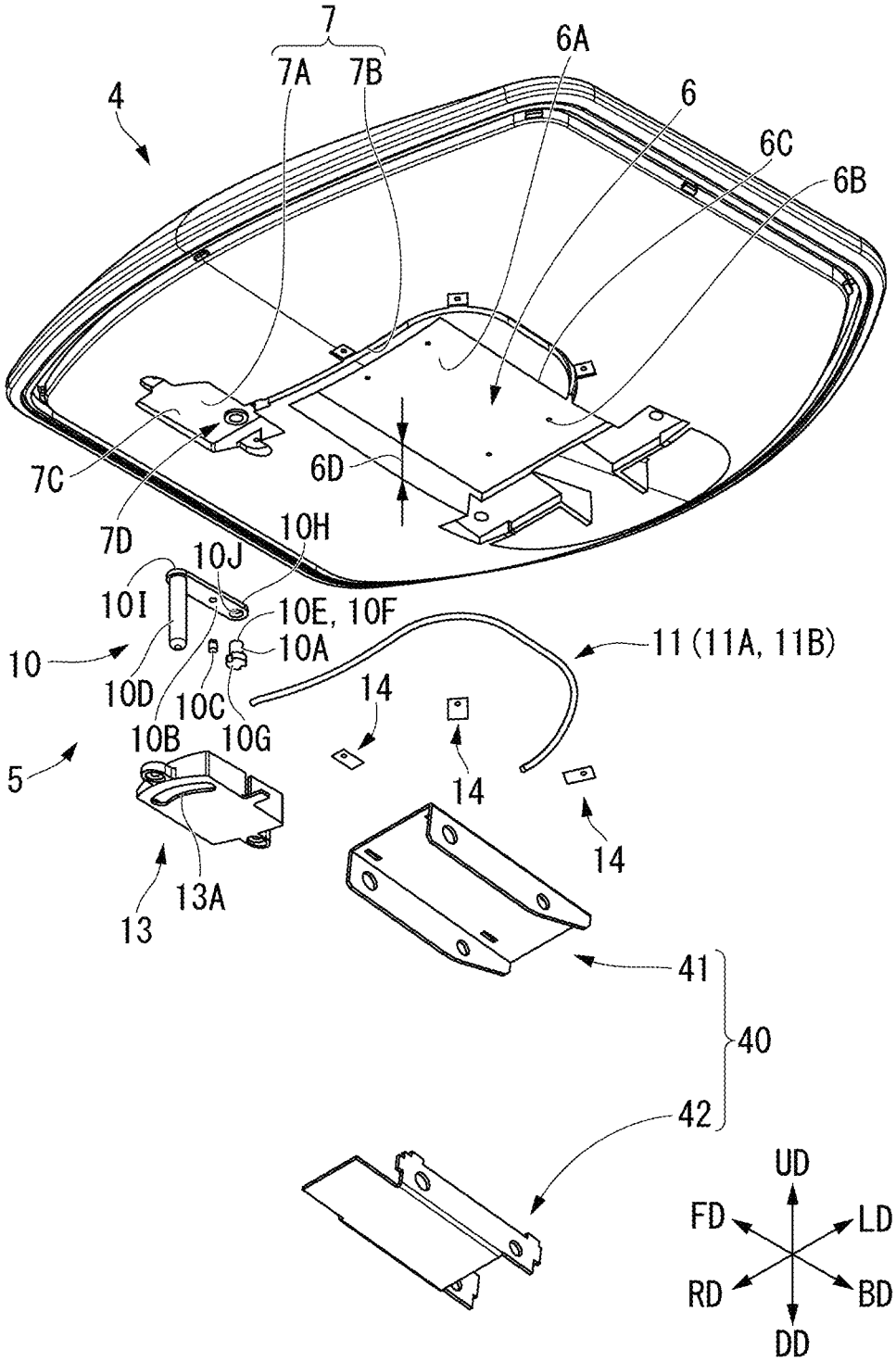
FIG. 2 An exploded perspective view showing a part of the chair according to one embodiment of the present invention, and showing components constituting a seat and a part of a support structure.
Figure 3:
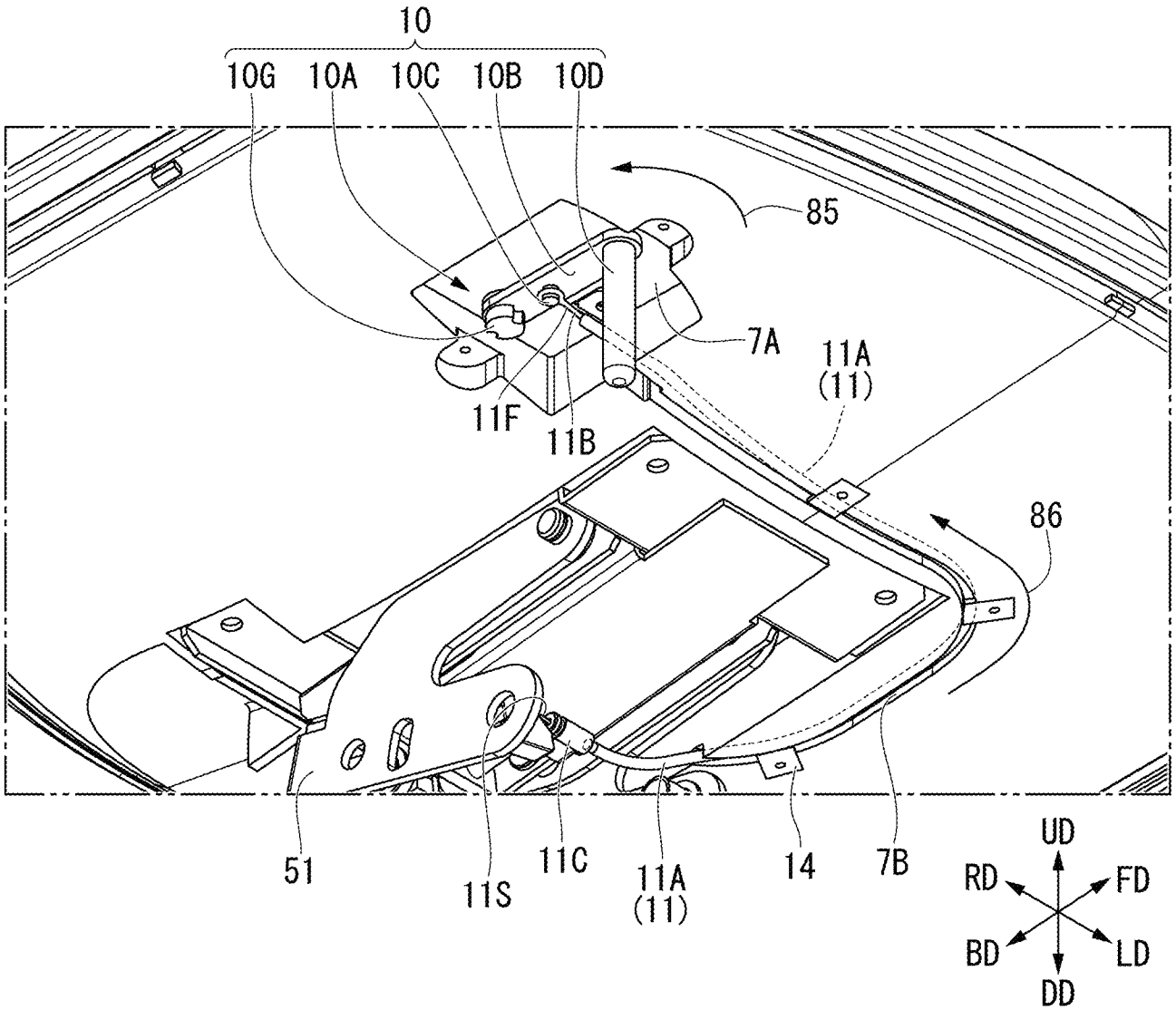
FIG. 3 A perspective view showing a part of an operation mechanism that constitutes the seat of the chair according to one embodiment of the present invention.

As shown in FIGS. 1, 2, and 3, the seat 1 has a seat main body 4 and an operation mechanism 5.

<Seat Main Body 4>

The seat main body 4 is a plate-shaped member that elastically supports the buttocks and thighs of the occupant.

The seat main body 4 is a plate that is parallel to the front-rear directions FD and BD or to a direction inclined with respect to the front-rear directions FD and BD, and is parallel to the left-right directions RD and LD. The seat main body 4 has a seat plate lower surface 4L facing in the downward direction DD and a seat plate upper surface 4U facing in the upward direction UD. The seat plate lower surface 4L faces the floor surface FS. The seat plate lower surface 4L is an example of a "lower surface". The seat plate upper surface 4U is a curved surface having a three-dimensional shape corresponding to shapes of the buttocks and thighs of the occupant. The seat plate upper surface 4U is covered with a tensile material 4M. As a material forming the seat main body 4, a known resin material or metal material is used. A material of the tensile material 4M is, for example, a fabric such as mesh.

A support mechanism housing portion 6 and an operation mechanism housing portion 7 are formed on the seat plate lower surface 4L.

Each of the support mechanism housing portion 6 and the operation mechanism housing portion 7 is an example of a "recessed portion". In order to distinguish between the support mechanism housing portion 6 and the operation mechanism housing portion 7, the support mechanism housing portion 6 may be referred to as a "first recess" and the operation mechanism housing portion 7 may be referred to as a "second recess".

<Support Mechanism Housing Portion 6>

The support mechanism housing portion 6 is formed substantially at a center of the seat main body 4 in the front-rear directions FD and BD and the left-right directions RD and LD.

The support mechanism housing portion 6 has a support recess surface 6A formed inside the support mechanism housing portion 6. Four seat support fastening holes 6B are formed on the support recess surface 6A. Each of the four seat support fastening holes 6B is, for example, a screw hole.

Regarding a depth of the support mechanism housing portion 6 in the upward direction UD from the seat plate lower surface 4L, the support mechanism housing portion 6 has a depth 6D from an edge part 6C of the support mechanism housing portion 6 to the support recess surface 6A in the upward direction UD. The depth 6D of the support mechanism housing portion 6 can be appropriately set according to a design of the seat main body 4 and a seat support member 40 to be described later.

<Operation Mechanism Housing Portion 7>

The operation mechanism housing portion 7 has a lever housing portion 7A and a wire housing portion 7B.

In the present embodiment, the lever housing portion 7A is formed at a position that is forward of the support mechanism housing portion 6 in the forward direction FD and rightward of the support mechanism housing portion 6 in the rightward direction RD. A position of the lever housing portion 7A is not limited to the position shown in FIG. 2. The lever housing portion 7A has a lever recess surface 7C formed inside the lever housing portion 7A. A shaft fixing hole 7D is formed in the lever recess surface 7C. The shaft fixing hole 7D is, for example, a screw hole.

The wire housing portion 7B is, for example, a groove formed on the seat plate lower surface 4L. A depth of the operation mechanism housing portion 7 in the upward direction UD from the seat plate lower surface 4L is appropriately set according to a size of each of a plurality of members constituting the operation mechanism 5. In a direction in which the wire housing portion 7B extends, the wire housing portion 7B has a partially formed bent portion and a straight portion.

In the example shown in FIG. 2, the wire housing portion 7B is formed in a substantially U shape when viewed in the upward direction UD. A shape of the wire housing portion 7B is set according to a design of the chair 100 taking into consideration a position of the lever housing portion 7A. For example, depending on a position of the lever housing portion 7A in the front-rear directions FD and BD and the left-right directions RD and LD, that is, a position of the lever housing portion 7A in the horizontal direction, a shape of the wire housing portion 7B may be an I shape or an inverted L shape. If a shape of the wire housing portion 7B is an I shape, the operation mechanism 5 can be provided on the seat plate lower surface 4L, for example, with a gap to be aligned with the support structure 3 in the left-right directions RD and LD.

<Operation Mechanism 5>

Figure 4:
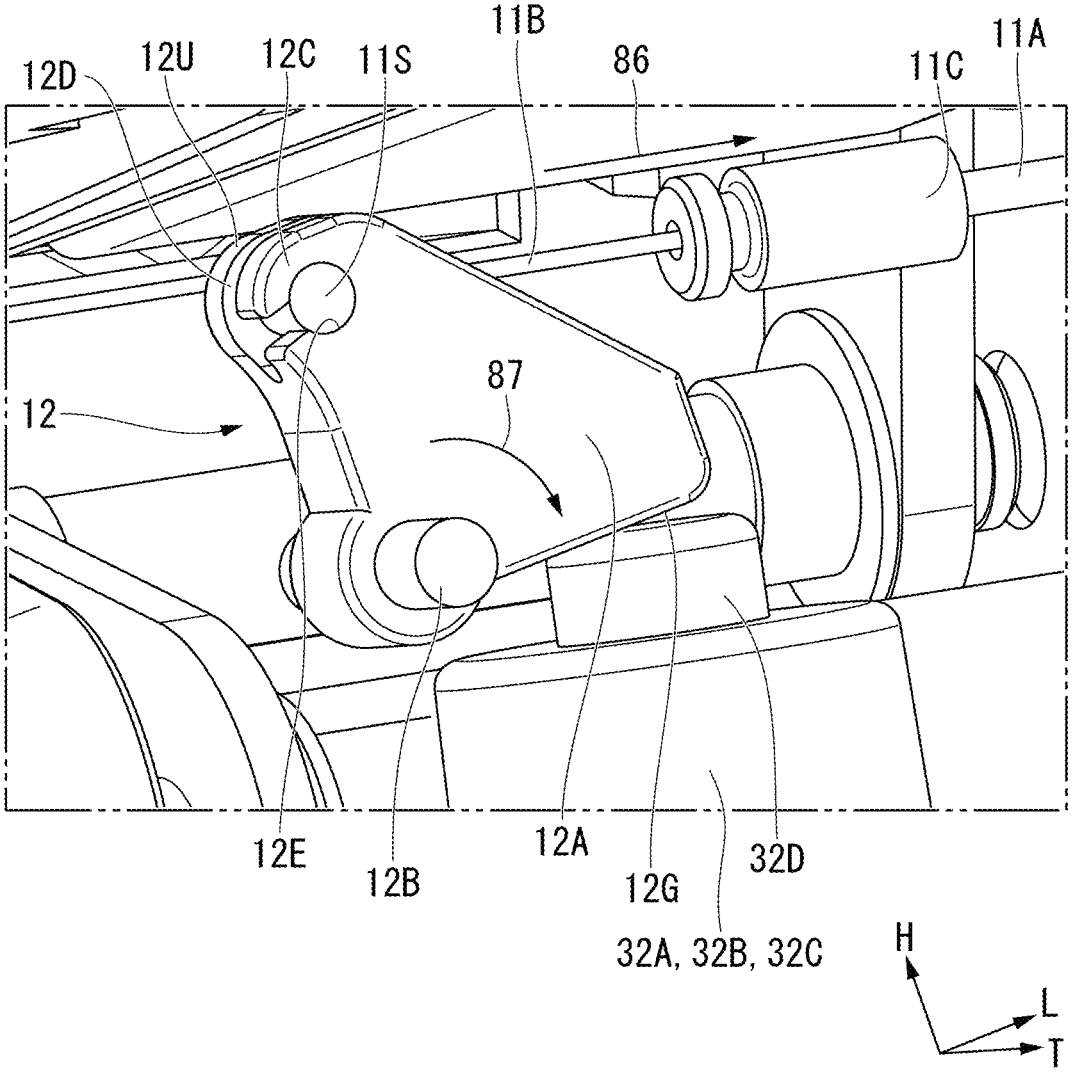
FIG. 4 A perspective view showing a part of the operation mechanism disposed inside a support base which constitutes a part of the support structure of the chair according to one embodiment of the present invention, and showing a state in which a support base cover has been removed.

As shown in FIGS. 2, 3, and 4, the operation mechanism 5 includes an operation unit 10, a wire structure 11, a pressing unit 12, an operation unit cover 13, and a wire holding claw 14. Furthermore, FIG. 3 shows a state in which the operation unit 10 has been removed from the seat plate lower surface 4L. FIG. 4 shows a part of the operation mechanism 5 disposed inside a support base 60 that constitutes a part of the support structure 3. In FIG. 4, illustration of a support base cover 65 is omitted. The support base 60 and the support base cover 65 will be described later.

The operation mechanism 5 is housed in the lever housing portion 7A and the wire housing portion 7B on the seat plate lower surface 4L. Furthermore, a part of the operation mechanism 5 is housed in the support base 60.

<Operation Unit 10>

The operation unit 10 includes a lever support shaft 10A, a lever plate 10B, a wire support portion 10C, and a lever 10D. The operation unit 10 is housed in the lever housing portion 7A.

<Lever Support Shaft 10A>

The lever support shaft 10A extends in the vertical directions UD and DD. The lever support shaft 10A has a screw groove portion 10E, a rotation support portion 10F, and a head portion 10G. The head portion 10G is positioned at an end part of the lever support shaft 10A in the downward direction DD. The screw groove portion 10E is screwed into the shaft fixing hole 7D. Therefore, the screw groove portion 10E is fixed to the operation mechanism housing portion 7. The lever support shaft 10A supports the lever plate 10B such that the lever plate 10B can rotate around the rotation support portion 10F. As a material forming the lever support shaft 10A, a known resin material or metal material is used.

<Lever Plate 10B>

The lever plate 10B extends in a direction orthogonal to the vertical directions UD and DD. The lever plate 10B has a support end portion 10H and a rotation end portion 10I. A support shaft hole 10J is formed in the support end portion 10H. The rotation support portion 10F is inserted into the support shaft hole 10J. A diameter of the support shaft hole 10J is smaller than a diameter of the head portion 10G. Therefore, falling off of the lever plate 10B from the operation mechanism housing portion 7 in the downward direction DD is prevented by the head portion 10G. As a material forming the lever plate 10B, a known resin material or metal material is used.

<Wire Support Portion 10C>

The wire support portion 10C is a protruding portion that protrudes in the downward direction DD from the lever plate 10B. The wire support portion 10C is positioned between the support end portion 10H and the rotation end portion 10I in a direction in which the lever plate 10B extends. The wire support portion 10C is fixed to a hole formed in the lever plate 10B.

<Lever 10D>

The lever 10D extends in the vertical directions UD and DD. An end part of the lever 10D in the upward direction UD is fixed to the rotation end portion 10I of the lever plate 10B. The lever 10D is a portion that allows, for example, the occupant to operate the operation unit 10 with his or her fingers. The lever 10D is rotatable around the lever support shaft 10A. Specifically, the lever 10D is movable to draw an arc-shaped trajectory in the horizontal direction. The arc-shaped trajectory is a partial arc of a circle centered on the lever support shaft 10A.

As a material forming the lever 10D, a known resin material or metal material is used. The lever 10D may be formed of the same member as the lever plate 10B to be integrated with it, or may be separable from the lever plate 10B to be a separate body with respect to the lever plate 10B.

The operation unit 10 with such a configuration is housed in the lever housing portion 7A. Considering operability of the operation unit 10 and the chair 100 by the occupant, a position of the operation unit 10 is set, and a position and a shape of the lever housing portion 7A are set.

When explained on the basis of the principle of leverage regarding a fulcrum, an effort point, and a point of action, in the operation unit 10 having the above-described configuration, the lever support shaft 10A corresponds to the fulcrum, the lever 10D corresponds to the effort point, and the wire support portion 10C of the lever plate 10B corresponds to the point of action. In such a structure utilizing the principle of leverage, the lever 10D and the wire support portion 10C are positioned in the horizontal direction.

A relative positional relationship among the lever support shaft 10A, the lever 10D, and the wire support portion 10C in a direction in which the lever plate 10B extends is appropriately set taking into consideration the principle of leverage and the operability of the chair 100.

<Wire Structure 11>

The wire structure 11 has an outer tube 11A, an inner wire 11B, a first wire engaging end 11F (first engaging end), and a second wire engaging end 11S (second engaging end). The wire structure 11 is supported by the wire housing portion 7B in the front-rear directions FD and BD and the left-right directions RD and LD. A length of the wire structure 11 is set according to a formation pattern of the wire housing portion 7B formed on the seat plate lower surface 4L and a design of the chair 100.

<Outer Tube 11A>

The outer tube 11A is, for example, a cylindrical body made of a soft resin. The outer tube 11A has flexibility. A space is formed inside the outer tube 11A. This space extends in a direction in which the outer tube 11A extends. The outer tube 11A is housed in and fixed to the wire housing portion 7B. The wire housing portion 7B statically holds the outer tube 11A. As such an outer tube 11A, a known outer tube is used.

<Inner Wire 11B>

The inner wire 11B has a structure in which, for example, a plurality of thin metal wires are woven together, and is flexible. The inner wire 11B is positioned in an internal space of the outer tube 11A and is movable relative to the outer tube 11A held by the wire housing portion 7B. In other words, the inner wire 11B is movable inside the fixed outer tube 11A while being deformed to extend in a direction in which the outer tube 11A extends. As such an inner wire 11B, a known inner wire is used.

<First Wire Engaging End 11F>

The first wire engaging end 11F is connected to a distal end (first distal end) of the inner wire 11B. Inside the lever housing portion 7A, the first wire engaging end 11F is engaged with the wire support portion 10C. The first wire engaging end 11F is rotatable around the wire support portion 10C. An engagement structure between the first wire engaging end 11F and the wire support portion 10C is not particularly limited. For example, a structure in which the wire support portion 10C and the first wire engaging end 11F each have a hook, and the two hooks engage with each other may be employed. The wire support portion 10C may have a small diameter portion having a small diameter and a large diameter portion having a larger diameter than the small diameter portion, and the first wire engaging end 11F may engage with the small diameter portion.

<Second Wire Engaging End 11S>

The second wire engaging end 11S is connected to a distal end (second distal end) of the inner wire 11B positioned on an upper surface of the support base cover 65. On the upper surface of the support base cover 65, the second wire engaging end 11S is engaged with the pressing unit 12.

<Pressing Unit 12>

As shown in FIG. 4, the pressing unit 12 includes a pressing main body 12A, a pressing support shaft 12B, a pressing engagement portion 12C, and a pressing force generation portion 12G.

<Pressing Main Body 12A>

The pressing main body 12A has, for example, a substantially triangular shape. A shape of the pressing main body 12A is not limited to a substantially triangular shape. As long as the pressing support shaft 12B, the pressing engagement portion 12C, and the pressing force generation portion 12G are provided, a shape of the pressing main body 12A can be appropriately selected. As a material forming the pressing main body 12A, a known resin material or metal material is used.

In the example shown in FIG. 4, the pressing unit 12 has a thickness in a direction indicated by reference sign T, a height in a direction indicated by reference sign H, and a length in a direction indicated by reference sign L. In the following description, the pressing unit 12 may be described using terms "thickness direction T," "height direction H," and "length direction L". Also, the height direction H is a direction parallel to or inclined with respect to the vertical directions UD and DD. The thickness direction T is a direction parallel to or inclined with respect to the front-rear directions FD and BD. The length direction L is a direction parallel to or inclined with respect to the left-right directions RD and LD.

<Pressing Support Shaft 12B>

The pressing support shaft 12B constitutes a part of the pressing main body 12A. The pressing support shaft 12B extends in the thickness direction T. The pressing support shaft 12B supports the pressing main body 12A such that the pressing main body 12A is rotatable around the pressing support shaft 12B. Furthermore, the pressing support shaft 12B may be formed of the same member as the pressing main body 12A to be integrated with it, or may be separable from the pressing main body 12A to be a separate body with respect to the pressing main body 12A.

In the present embodiment, the pressing support shaft 12B is rotatably supported by the support base cover 65 to be described later. If the pressing main body 12A is rotatable around the pressing support shaft 12B, the pressing support shaft 12B may be supported by the support base 60.

<Pressing Engagement Portion 12C>

The pressing engagement portion 12C is formed on the pressing main body 12A at a position spaced apart from the pressing support shaft 12B in the height direction H. The pressing engagement portion 12C constitutes a part of the pressing main body 12A. The pressing engagement portion 12C has a wire insertion groove 12D and a wire support groove 12E. The wire insertion groove 12D is a groove through which the second wire engaging end 11S is inserted when the second wire engaging end 11S is hooked onto the pressing unit 12. The wire support groove 12E is a groove that supports the second wire engaging end 11S.

<Wire Insertion Groove 12D>

The wire insertion groove 12D is formed to extend, for example, in the height direction H from an upper end 12U of the pressing main body 12A toward the inside of the pressing main body 12A. A depth of the wire insertion groove 12D in the height direction H is not particularly limited, but the wire insertion groove 12D only needs to be deep enough to support the second wire engaging end 11S. The wire insertion groove 12D is positioned substantially at a center in the thickness direction T.

<Wire Support Groove 12E>

The wire support groove 12E has a shape corresponding to a shape of the second wire engaging end 11S.

The wire support groove 12E is provided on a surface of the pressing main body 12A on a side opposite to the second wire engaging end 11S. The wire support groove 12E is formed to extend toward the inside of the pressing main body 12A in the length direction L or in a direction inclined with respect to the length direction L. A depth of the wire support groove 12E in the length direction L is not particularly limited, but the wire support groove 12E only needs to be deep enough to support the second wire engaging end 11S.

An engagement structure between the pressing engagement portion 12C and the second wire engaging end 11S is not particularly limited. For example, a structure in which the pressing engagement portion 12C and the second wire engaging end 11S each have a hook, and the two hooks engage with each other may be employed.

<Pressing Force Generation Portion 12G>

The pressing force generation portion 12G is formed on the pressing main body 12A at a position spaced apart from the pressing support shaft 12B in the length direction L. In the example shown in FIG. 4, the pressing force generation portion 12G is a surface formed on a part of the pressing main body 12A. The pressing force generation portion 12G is positioned on a lower portion of the pressing main body 12A in the height direction H.

When explained on the basis of the principle of leverage regarding a fulcrum, an effort point, and a point of action, in the pressing unit 12 having the above-described configuration, the pressing support shaft 12B corresponds to the fulcrum, the pressing engagement portion 12C corresponds to the effort point, and the pressing force generation portion 12G corresponds to the point of action. In such a structure utilizing the principle of leverage, the pressing engagement portion 12C and the pressing force generation portion 12G are positioned to be aligned in the height direction H. In other words, the pressing engagement portion 12C and the pressing force generation portion 12G are positioned to be aligned in a direction different from the horizontal direction. A relative positional relationship among the pressing support shaft 12B, the pressing engagement portion 12C, and the pressing force generation portion 12G in the height direction H and length direction L is appropriately set taking into consideration the principle of leverage and the operability of the chair 100.

<Operation Unit Cover 13>

As shown in FIG. 2, the operation unit cover 13 is a portion fitted into the lever housing portion 7A. A through hole 13A is formed in the operation unit cover 13. The lever 10D is inserted through the through hole 13A. The through hole 13A has an arc shape such that the lever 10D is movable within an arc-shaped movement range. The operation unit cover 13 is fastened to the seat main body 4 using a fastening member such as a bolt which is not shown in the drawings. In a state in which the operation unit cover 13 is fitted into the lever housing portion 7A, a part of the lever 10D passing through the through hole 13A is exposed from the seat plate lower surface 4L, and the operation unit 10 is housed in a space formed between the operation unit cover 13 and the lever housing portion 7A.

<Wire Holding Claw 14>

The wire holding claw 14 is placed on the seat plate lower surface 4L in a direction in which the groove-shaped wire housing portion 7B extends. The wire holding claw 14 holds the wire structure 11 disposed in the wire housing portion 7B. The wire holding claw 14 is fixed to the seat plate lower surface 4L using a fastening member such as, for example, a bolt which is not shown in the drawings. The wire holding claw 14 covers an opening end part of the groove-shaped wire housing portion 7B in the downward direction DD at a suitable position in the horizontal direction. Therefore, the wire holding claw 14 prevents the wire structure 11 from falling off from the wire housing portion 7B in the downward direction DD. Furthermore, the wire holding claw 14 may be integrally formed on the seat plate lower surface 4L.

<Backrest 2>

The backrest 2 is tiltable with respect to the seat 1.

Figure 5:
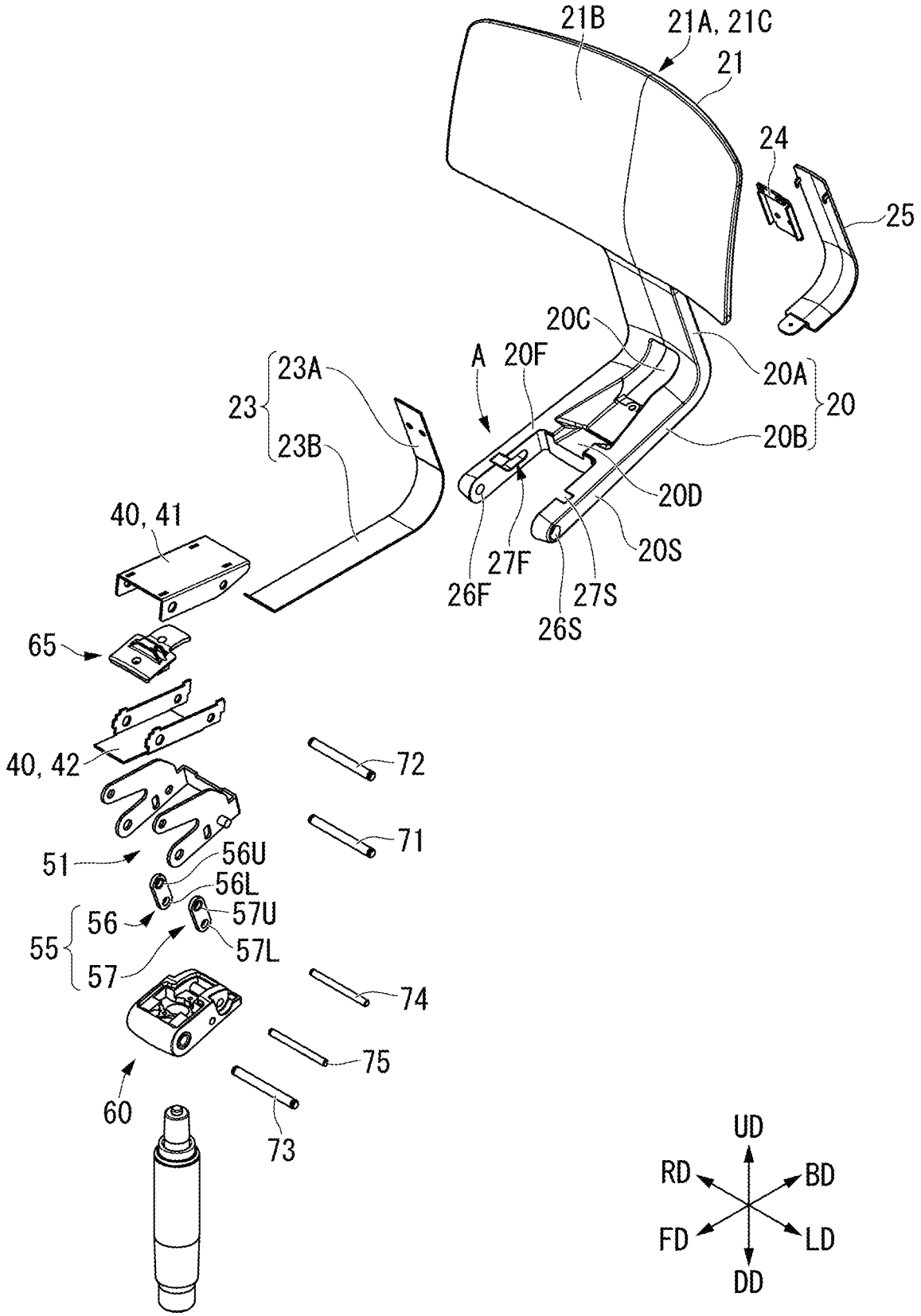
FIG. 5 An exploded perspective view showing a part of the chair according to one embodiment of the present invention, and showing components constituting a backrest and the support structure.
Figure 6:
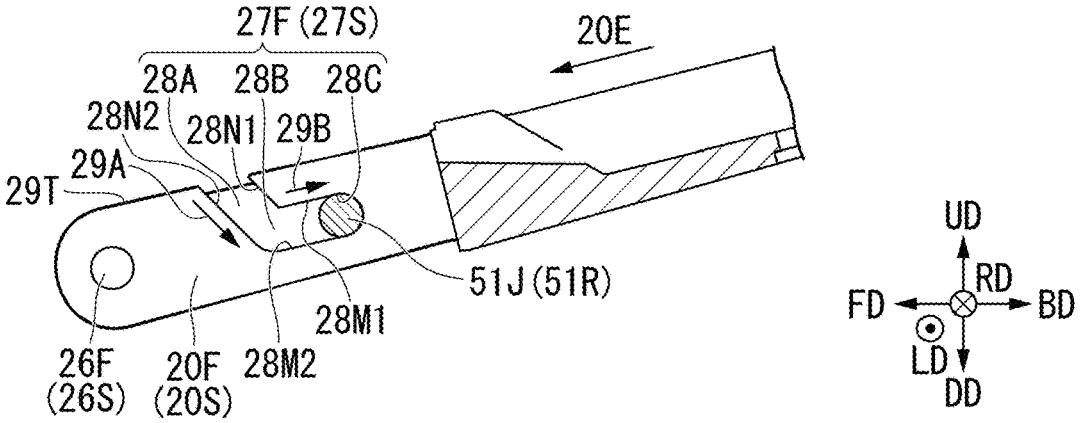
FIG. 6 An enlarged side view showing a main part of an arm portion constituting the backrest of the chair according to one embodiment of the present invention.
Figure 7:
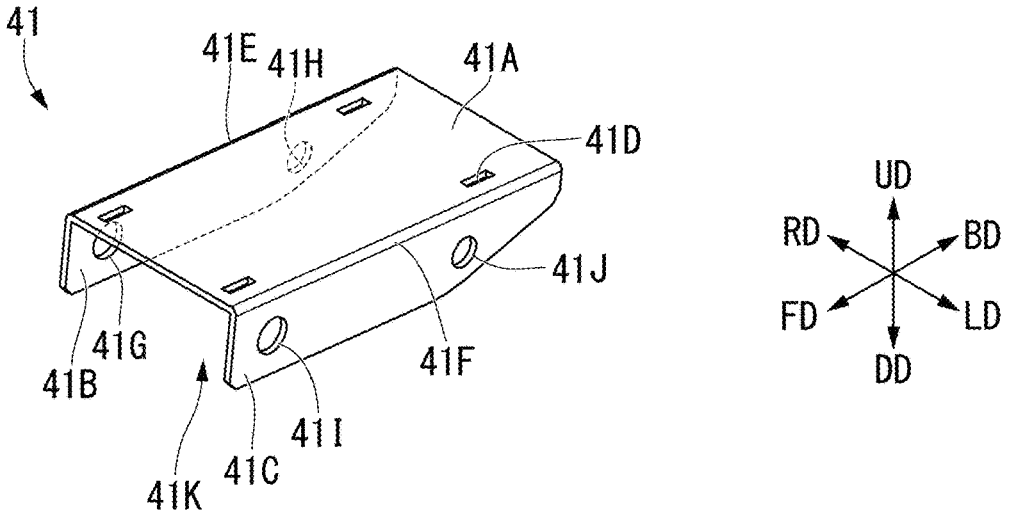
FIG. 7 A perspective view showing a first seat support member constituting the support structure of the chair according to one embodiment of the present invention.
Figure 8:
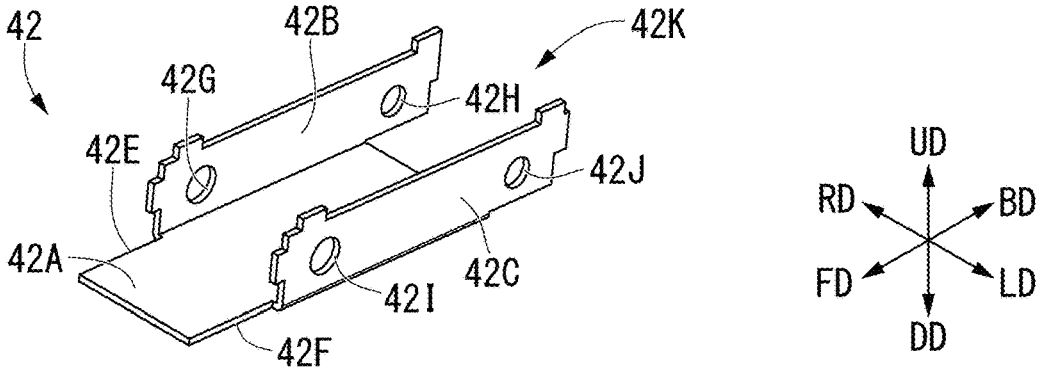
FIG. 8 A perspective view showing a second seat support member constituting the support structure of the chair according to one embodiment of the present invention.

As shown in FIGS. 1, 5, and 6, the backrest 2 has an arm portion 20, a back support portion 21, an elastic member support portion 24, and a backrest cover 25. The backrest 2 is a portion that supports the back of the occupant. As a material forming the arm portion 20, the back support portion 21, the elastic member support portion 24, and the backrest cover 25, a known resin material or metal material is used.

<Arm Portion 20>

The arm portion 20 is supported by the support structure 3.

The arm portion 20 is formed in a substantially L shape when viewed in the rightward direction RD. The arm portion 20 has a vertical arm 20A and a horizontal arm 20B. The vertical arm 20A is positioned below the seat main body 4. The vertical arm 20A extends in the vertical directions UD and DD. The horizontal arm 20B extends in the front-rear directions FD and BD. The vertical arm 20A may be formed of the same member as the horizontal arm 20B to be integrated with it, or may be separable from the horizontal arm 20B to be a separate body with respect to the horizontal arm 20B.

The vertical arm 20A supports the back support portion 21. The horizontal arm 20B includes an arm opening 20C, a first support arm 20F, a second support arm 20S, and a reinforcing arm 20D. The arm opening 20C is an opening through which a part of the elastic member 23 is inserted when the elastic member 23 is attached to a back surface of the vertical arm 20A facing the rearward direction BD. The reinforcing arm 20D extends in the left-right directions RD and LD. The reinforcing arm 20D is provided between the first support arm 20F and the second support arm 20S. Therefore, a strength of the horizontal arm 20B is improved.

<First Support Arm 20F>

The first support arm 20F has a first shaft support hole 26F. The first shaft support hole 26F is provided on a side opposite to the vertical arm 20A with respect to the first support arm 20F. In other words, the first shaft support hole 26F is positioned in front of the first support arm 20F in the forward direction FD. The first support arm 20F is attached to a rear part of the support base 60 via the first shaft support hole 26F. The first support arm 20F has a first arm groove 27F provided between the first shaft support hole 26F and the reinforcing arm 20D. The first arm groove 27F opens in the leftward direction LD.

FIG. 6 is an enlarged view of a portion indicated by reference sign A in FIG. 5. In other words, FIG. 6 is a side view from the second support arm 20S in the rightward direction RD, partially showing the first support arm 20F. The first arm groove 27F has an oblique opening groove 28A, a front-rear extending groove 28B, and a groove depth portion 28C. The first arm groove 27F opens in the leftward direction LD. In other words, the first arm groove 27F is exposed to a space between the first support arm 20F and the second support arm 20S.

The oblique opening groove 28A is formed in the first support arm 20F to extend in a groove inclination direction 29A. Here, the groove inclination direction 29A is a direction from an arm upper surface 29T of the first support arm 20F toward the inside of the first support arm 20F. In other words, the groove inclination direction 29A is a direction inclined with respect to an extension direction 20E in which the first support arm 20F extends. The oblique opening groove 28A opens in the upward direction UD and the leftward direction LD on the arm upper surface 29T.

The oblique opening groove 28A has two oblique groove walls 28N1 and 28N2 facing each other. A width between the two oblique groove walls 28N1 and 28N2 is slightly larger than a diameter of a right arm engagement portion 51J to be described later. Therefore, the right arm engagement portion 51J can be inserted between the oblique groove walls 28N1 and 28N2 of the oblique opening groove 28A.

The front-rear extending groove 28B is formed in the first support arm 20F to be continuous with the oblique opening groove 28A in the groove inclination direction 29A. The front-rear extending groove 28B extends in the extension direction 20E. The front-rear extending groove 28B opens in the groove inclination direction 29A and in the leftward direction LD.

The front-rear extending groove 28B has two extending groove walls 28M1 and 28M2 facing each other. The extending groove wall 28M1 is a surface that is continuous with the oblique groove wall 28N1. The extending groove wall 28M2 is a surface that is continuous with the oblique groove wall 28N2.

A width between the two extending groove walls 28M1 and 28M2 is slightly larger than a diameter of the right arm engagement portion 51J to be described later. Therefore, the right arm engagement portion 51J can be inserted between the extending groove walls 28M1 and 28M2 of the front-rear extending groove 28B.

The groove depth portion 28C is a portion positioned at a rearmost part of the front-rear extending groove 28B. In other words, the groove depth portion 28C is a portion positioned at an end part of the front-rear extending groove 28B in a groove extension direction 29B. The groove extension direction 29B is a direction parallel to the extension direction 20E. The groove depth portion 28C opens in the extension direction 20E and the leftward direction LD.

The groove depth portion 28C has a curved surface. The curved surface of the groove depth portion 28C has a shape that follows a surface shape of the right arm engagement portion 51J.

<Second Support Arm 20S>

The second support arm 20S has a second shaft support hole 26S. The second shaft support hole 26S is provided on a side opposite to the vertical arm 20A with respect to the second support arm 20S. In other words, the second shaft support hole 26S is positioned in front of the second support arm 20S in the forward direction FD. The second support arm 20S is attached to a rear part of the support base 60 via the second shaft support hole 26S. The second support arm 20S has a second arm groove 27S provided between the second shaft support hole 26S and the reinforcing arm 20D. The second arm groove 27S opens in the rightward direction RD.

Similarly to the first arm groove 27F of the first support arm 20F, the second arm groove 27S has the oblique opening groove 28A, the front-rear extending groove 28B, and the groove depth portion 28C. The second arm groove 27S opens in the rightward direction RD. In other words, the second arm groove 27S is exposed to the space between the first support arm 20F and the second support arm 20S.

The oblique opening groove 28A is formed in the second support arm 20S to extend in the groove inclination direction 29A. Here, the groove inclination direction 29A is a direction from the arm upper surface 29T of the second support arm 20S toward the inside of the second support arm 20S. In other words, the groove inclination direction 29A is a direction inclined with respect to the extension direction 20E in which the second support arm 20S extends. The oblique opening groove 28A opens in the upward direction UD and the rightward direction RD on the arm upper surface 29T.

The oblique opening groove 28A has two oblique groove walls 28N1 and 28N2 facing each other. A width between the two oblique groove walls 28N1 and 28N2 is slightly larger than a diameter of a left arm engagement portion 51R to be described later. Therefore, the left arm engagement portion 51R can be inserted between the oblique groove walls 28N1 and 28N2 of the oblique opening groove 28A.

The front-rear extending groove 28B is formed in the second support arm 20S to be continuous with the oblique opening groove 28A in the groove inclination direction 29A. The front-rear extending groove 28B extends in the extension direction 20E. The front-rear extending groove 28B opens in the groove inclination direction 29A and in the rightward direction RD.

The front-rear extending groove 28B has two extending groove walls 28M1 and 28M2 facing each other. The extending groove wall 28M1 is a surface that is continuous with the oblique groove wall 28N1. The extending groove wall 28M2 is a surface that is continuous with the oblique groove wall 28N2.

A width between the two extending groove walls 28M1 and 28M2 is slightly larger than a diameter of the left arm engagement portion 51R to be described later. Therefore, the left arm engagement portion 51R can be inserted between the extending groove walls 28M1 and 28M2 of the front-rear extending groove 28B.

The groove depth portion 28C is a portion positioned at a rearmost part of the front-rear extending groove 28B. In other words, the groove depth portion 28C is a portion positioned at an end part of the front-rear extending groove 28B in the groove extension direction 29B. The groove extension direction 29B is a direction parallel to the extension direction 20E. The groove depth portion 28C opens in the extension direction 20E and the rightward direction RD.

The groove depth portion 28C has a curved surface. The curved surface of the groove depth portion 28C has a shape that follows a surface shape of the left arm engagement portion 51R.

The second arm groove 27S and the first arm groove 27F are in an axially symmetrical relationship with respect to a central axis CL (see FIG. 1) passing through a center of the chair 100 in the left-right directions RD and LD and extending in the front-rear directions FD and BD.

<Back Support Portion 21>

The back support portion 21 is positioned above the vertical arm 20A in the vertical directions UD and DD. The back support portion 21 is supported by the vertical arm 20A.

The back support portion 21 is disposed behind the seat 1 in the rearward direction BD. The back support portion 21 is tiltable with respect to the seat 1. The back support portion 21 has a back receiving support portion 21A and a back receiving surface forming portion 21B. The back receiving support portion 21A is fastened to the vertical arm 20A using a fastening member such as a bolt which is not shown in the drawings. Therefore, the back receiving support portion 21A is supported by the arm portion 20. The back support portion 21 extends in the vertical directions UD and DD and is tiltable in the vertical directions UD and DD in conjunction with rotation of the arm portion 20. A material of a tensile material forming the back receiving surface forming portion 21B is, for example, a fabric such as mesh.

Furthermore, the back receiving support portion 21A may be formed integrally with the vertical arm 20A. A known cushion member covered with a fabric material may be attached to the back receiving surface forming portion 21B. The back receiving surface forming portion 21B may be covered with a fabric material.

<Elastic Member Support Portion 24>

The elastic member support portion 24 is a member that fixes a vertical spring portion 23A to a back surface 21C of the back receiving support portion 21A. The elastic member support portion 24 allows the vertical spring portion 23A to be fastened to the back surface 21C of the back receiving support portion 21A using a fastening member such as a bolt which is not shown in the drawings.

<Backrest Cover 25>

The backrest cover 25 is fixed to the vertical arm 20A to cover the elastic member support portion 24 and the vertical spring portion 23A. Therefore, the elastic member support portion 24 and the vertical spring portion 23A are not exposed to the outside of the chair 100. When the backrest cover 25 is fastened to the vertical arm 20A, design quality of the chair 100 is enhanced.

<Elastic Member 23>

The elastic member 23 is supported by the seat plate lower surface 4L of the seat 1. The elastic member 23 is, for example, a known leaf spring. The elastic member 23 is a plate-shaped member formed of, for example, a synthetic resin or metal. The elastic member 23 is formed in a substantially L shape when viewed in the rightward direction RD. The elastic member 23 has the vertical spring portion 23A and a horizontal spring portion 23B. A spring structure constituting the elastic member 23 is not limited to a leaf spring. A known spring other than a leaf spring can be applied to the elastic member 23.

The elastic member 23 having the above-described configuration elastically deforms in the vertical directions UD and DD and the front-rear directions FD and BD due to rotation of the backrest 2. The elastic member 23 is a member that applies a restoring force caused by elastic deformation to the seat 1 and the backrest 2, thereby returning the seat 1 and the backrest 2 to a front limit position 81. Here, the elastic deformation occurring in the elastic member 23 refers to an elastic deformation of the elastic member 23 caused by an action of a force applied to the elastic member 23. This point will be described in detail.

A state of the chair 100 in which the occupant is not pressing against the backrest 2 with his/her back is defined as an initial state.

A state of the chair 100 in which the occupant presses the backrest 2 with his/her back is defined as a tilted state.

"The elastic member 23 is elastically deformed" means that the elastic member 23 is elastically deformed in the process in which a state of the chair 100 changes from the initial state to the tilted state.

Here, in a state in which the elastic member 23 is assembled to the chair 100, that is, in the initial state, elastic deformation may occur in advance in the elastic member 23. In other words, in a state in which the elastic member 23 is assembled to the chair 100, the elastic member 23 may apply a restoring force (initial reaction force) to members constituting the chair 100.

<Support Structure 3>

As shown in FIG. 1, the support structure 3 supports the seat plate lower surface 4L of the seat 1 and the backrest 2. Therefore, the support structure 3 supports the chair 100 on the floor surface FS. In the present embodiment, the support structure 3 supports the seat 1 via the seat plate lower surface 4L, but the support structure 3 may support the seat 1 via a portion other than the seat plate lower surface 4L. For example, the support structure 3 may support the seat 1 via side surfaces of the seat 1 in the left-right directions RD and LD.

The support structure 3 includes a leg portion 30, the seat support member 40, and a shaft support mechanism 50.

<Leg Portion 30>

As shown in FIG. 1, the leg portion 30 is placed on the floor surface FS.

The leg portion 30 has a multi-pronged leg 31 with a plurality of casters 31*a*, and a leg column 33 that stands upright from a center of the multi-pronged leg 31 and incorporates a gas spring 32 serving as a lifting mechanism. The leg column 33 has an inner cylinder 34 and an outer cylinder 35. The outer cylinder 35 is non-rotatably fitted to and supported by the multi-pronged leg 31. A lower part of the inner cylinder 34 is rotatable around an axis parallel to the vertical directions UD and DD. In other words, the lower part of the inner cylinder 34 is supported to be rotatable relative to the outer cylinder 35. An upper part of the inner cylinder 34 is fixed to the support base 60 that constitutes the shaft support mechanism 50.

As the gas spring 32, a known gas spring is used. The gas spring 32 includes, for example, a cylinder 32A, a piston 32B, and a lock mechanism 32C. The cylinder 32A is filled with compressed gas. The piston 32B is movable in the vertical directions UD and DD inside the cylinder 32A. The lock mechanism 32C is a mechanism for fixing a position of the piston 32B in the vertical directions UD and DD, or for releasing a fixed state at the position of the piston 32B. Specifically, the lock mechanism 32C has a lock release protruding portion 32D that protrudes from the gas spring 32 in the upward direction UD. As shown in FIG. 4, the lock release protruding portion 32D is in contact with the pressing force generation portion 12G of the pressing unit 12 to be slidable.

<Seat Support Member 40>

As shown in FIGS. 2, 5, 7, 8, 12, and 13, the seat support member 40 is housed in the support mechanism housing portion 6 at the seat plate lower surface 4L. A size of the support mechanism housing portion 6 in the front-rear directions FD and BD and the left-right directions RD and LD, that is, in the horizontal direction is set according to a size of the seat support member 40. The depth 6D of the support mechanism housing portion 6 is set to be larger than a height 40H of the seat support member 40 in the vertical directions UD and DD.

In other words, the support mechanism housing portion 6 is capable of housing the seat support member 40 inside the support mechanism housing portion 6. When viewed in the left-right directions RD and LD, the seat support member 40 overlaps the seat main body 4.

The seat support member 40 is constituted by a first seat support member 41 and a second seat support member 42.

The first seat support member 41 and the second seat support member 42 are each formed of a metal plate. The first seat support member 41 and the second seat support member 42 are each formed by, for example, known sheet-metal processing. A type of material or a thickness of the metal plate for forming the seat support member 40 is not particularly limited as long as the strength member is configured to have a sufficient strength to support the occupant seated on the seat 1.

<First Seat Support Member 41>

The first seat support member 41 includes a first plate main body 41A, a first right plate portion 41B, and a first left plate portion 41C.

The first plate main body 41A extends parallel to the front-rear directions FD and BD or to a direction inclined with respect to the front-rear directions FD and BD. The first plate main body 41A is connected to the first right plate portion 41B and the first left plate portion 41C in the left-right directions RD and LD. Four through holes 41D are provided in the first plate main body 41A. Positions of the four through holes 41D in the first plate main body 41A correspond one-to-one to positions of the four seat support fastening holes 6B formed in the support recess surface 6A. The first plate main body 41A is fastened to the support mechanism housing portion 6 and fixed to the seat main body 4 using a fastening member such as a bolt which is not shown in the drawings.

As a fixing structure for fixing the first seat support member 41 and the seat main body 4, for example, a known fixing structure using a screw is employed. Furthermore, a fixing structure is not limited to screw fixing.

The first right plate portion 41B is a portion extending in the downward direction DD from a right end part 41E of the first plate main body 41A in the rightward direction RD. A first right front hole 41G and a first right rear hole 41H are formed in the first right plate portion 41B. The first right front hole 41G is a hole that is provided at a position forward of the first right rear hole 41H in the front-rear directions FD and BD. In other words, the first right rear hole 41H is a hole that is provided at a position rearward of the first right front hole 41G in the front-rear directions FD and BD.

The first left plate portion 41C is a portion extending in the downward direction DD from a left end part 41F of the first plate main body 41A in the leftward direction LD. A first left front hole 41I and a first left rear hole 41J are formed in the first left plate portion 41C. The first left front hole 41I is a hole that is provided at a position forward of the first left rear hole 41J in the front-rear directions FD and BD. In other words, the first left rear hole 41J is a hole that is provided at a position rearward of the first left front hole 41I in the front-rear directions FD and BD.

A first seat support space 41K is formed between the first right plate portion 41B and the first left plate portion 41C in the left-right directions RD and LD. In other words, the first seat support member 41 is formed in a substantially C shape that opens in the downward direction DD. The second seat support member 42 is disposed in the first seat support space 41K. A distance between the first right plate portion 41B and the first left plate portion 41C in the left-right directions RD and LD is larger than a distance between the second right plate portion 42B and the second left plate portion 42C of the second seat support member 42.

<Second Seat Support Member 42>

The second seat support member 42 has a second plate main body 42A, a second right plate portion 42B, and a second left plate portion 42C.

The second plate main body 42A extends parallel to the front-rear directions FD and BD or to a direction inclined with respect to the front-rear directions FD and BD. The second plate main body 42A is connected to the second right plate portion 42B and the second left plate portion 42C in the left-right directions RD and LD. The second plate main body 42A is fixed to the elastic member 23 using a fastening member such as a bolt which is not shown in the drawings.

The second right plate portion 42B is a portion that extends in the upward direction UD from a right end part 42E of the second plate main body 42A in the rightward direction RD. A second right front hole 42G and a second right rear hole 42H are formed in the second right plate portion 42B. The second right front hole 42G is a hole that is provided at a position forward of the second right rear hole 42H in the front-rear directions FD and BD. In other words, the second right rear hole 42H is a hole that is provided at a position rearward of the second right front hole 42G in the front-rear directions FD and BD.

The second left plate portion 42C is a portion that extends in the upward direction UD from a left end part 42F of the second plate main body 42A in the leftward direction LD. A second left front hole 42I and a second left rear hole 42J are formed in the second left plate portion 42C. The second left front hole 42I is a hole provided at a position forward of the second left rear hole 42J in the front-rear directions FD and BD. In other words, the second left rear hole 42J is a hole that is provided at a position rearward of the second left front hole 42I in the front-rear directions FD and BD.

A second seat support space 42K is formed between the second right plate portion 42B and the second left plate portion 42C in the left-right directions RD and LD. In other words, the second seat support space 42K is formed in a substantially C shape that opens in the upward direction UD.

Figure 12:
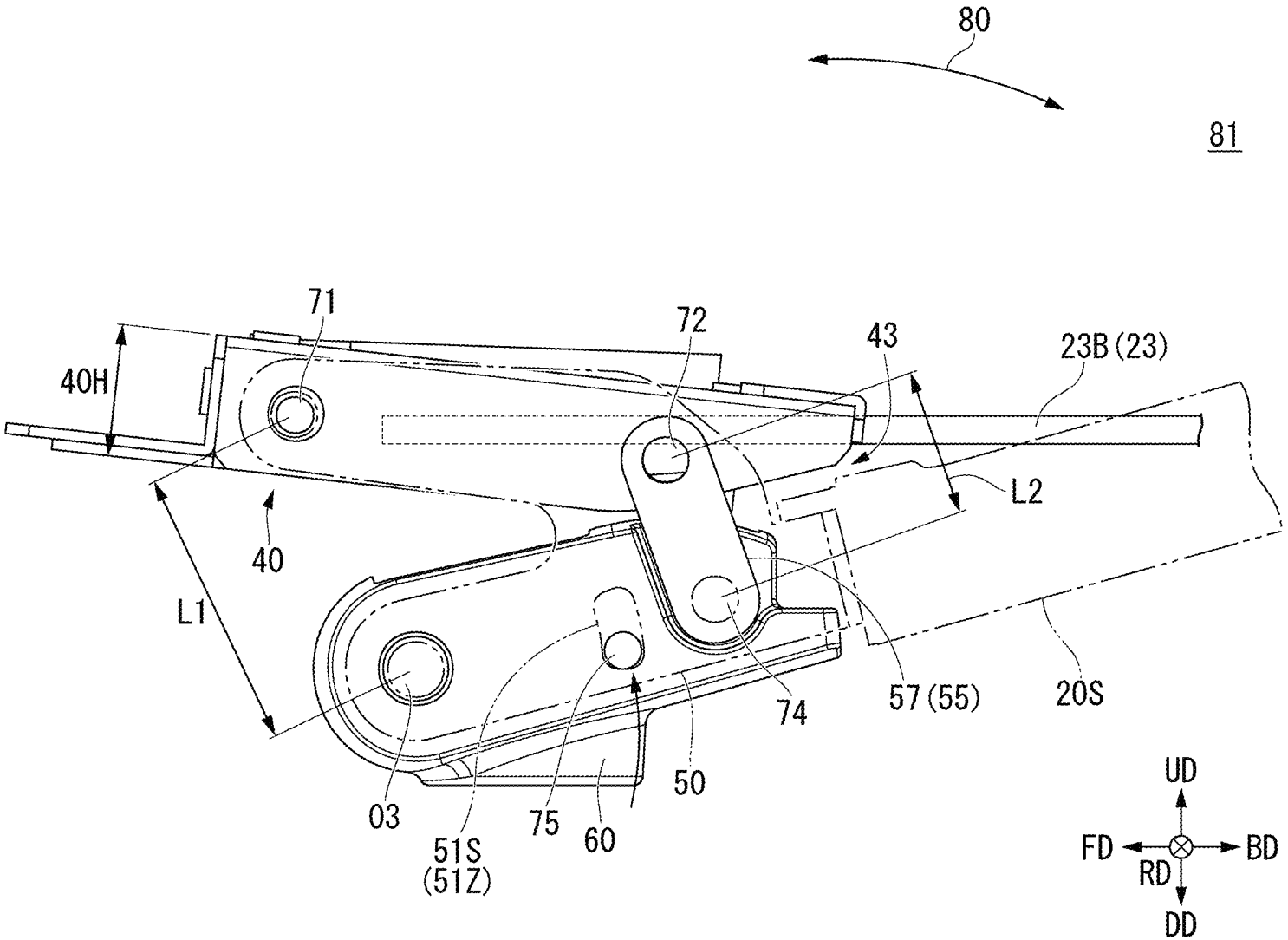
FIG. 12 A side view partially showing a structure in which the seat, the backrest, and the support structure constituting the chair according to one embodiment of the present invention are combined, and showing a state in which the backrest is disposed at a front limit position.
Figure 13:
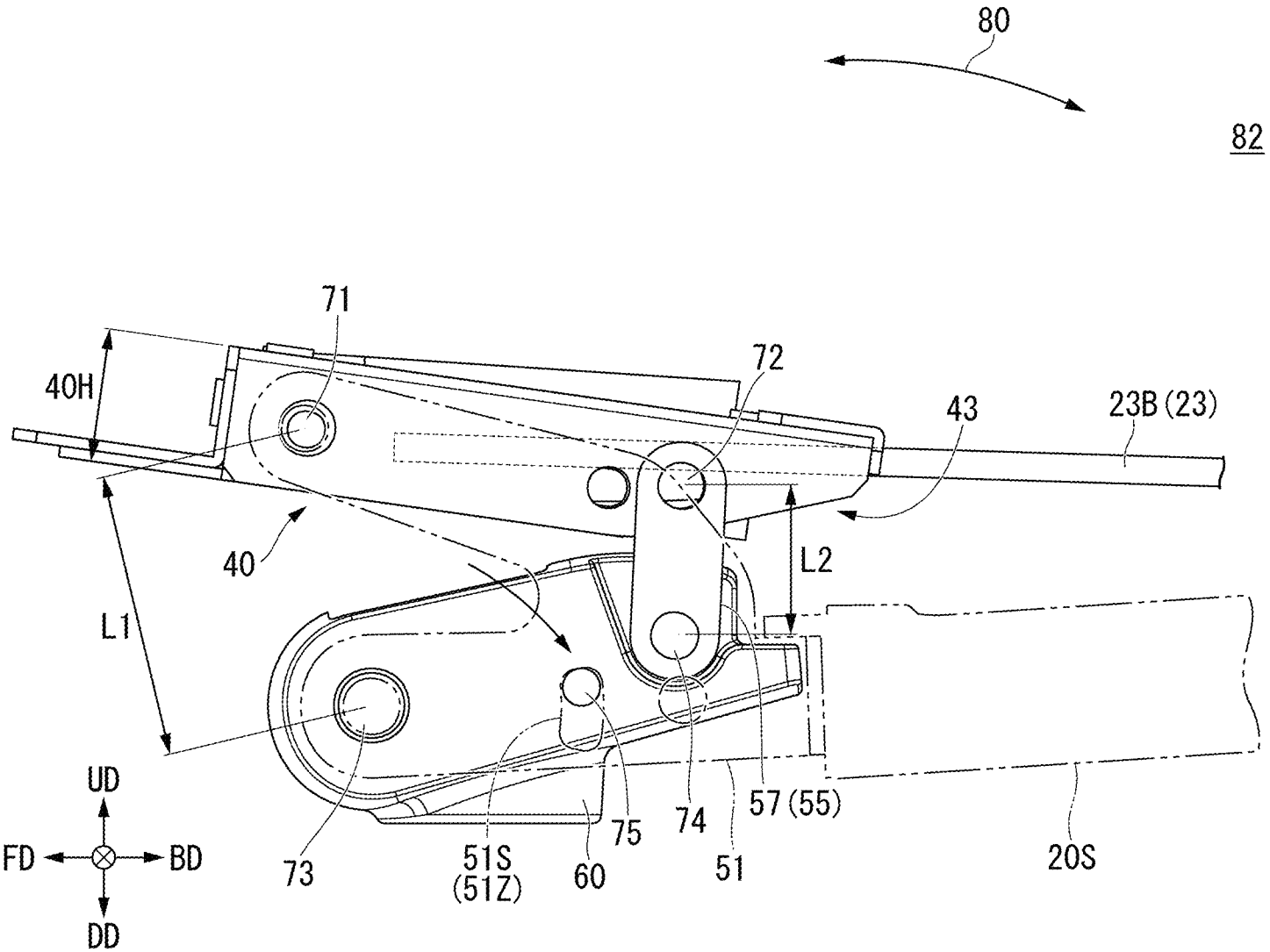
FIG. 13 A side view partially showing a structure in which the seat, the backrest, and the support structure constituting the chair according to one embodiment of the present invention are combined, and showing a state in which the backrest is disposed at a rear limit position.

As shown in FIGS. 12 and 13, the seat support member 40 is configured by combining the first seat support member 41 and the second seat support member 42 such that the first plate main body 41A and the second plate main body 42A face each other. In this structure, distal ends of the second right plate portion 42B and the second left plate portion 42C come into contact with the first plate main body 41A, thereby defining a gap between the first seat support member 41 and the second seat support member 42. This gap is an elastic member insertion hole 43 into which the elastic member 23 is inserted. In other words, the elastic member insertion hole 43 is a hole that communicates with a space common to the first seat support space 41K and the second seat support space 42K. The elastic member 23 inserted into the seat support member 40 through the elastic member insertion hole 43 reaches the second seat support space 42K and is fixed to the second plate main body 42A.

<Shaft Support Mechanism 50>

As shown in FIGS. 1, 4, 5, and 9 to 11, the shaft support mechanism 50 includes a support connector 51, a support link 55, the support base 60, the support base cover 65, a first shaft portion 71, a second shaft portion 72, a third shaft portion 73, a fourth shaft portion 74, and a rotation restriction pin 75. The support connector 51 and the support link 55 are each formed of a metal plate. For example, the support connector 51 and the support link 55 are each formed by known sheet-metal processing. Types of material or thicknesses of the metal plates for forming the support connector 51 and the support link 55 are not particularly limited as long as the strength member is configured to have a sufficient strength to support the occupant seated on the seat 1.

<Support Connector 51>

Figure 9:
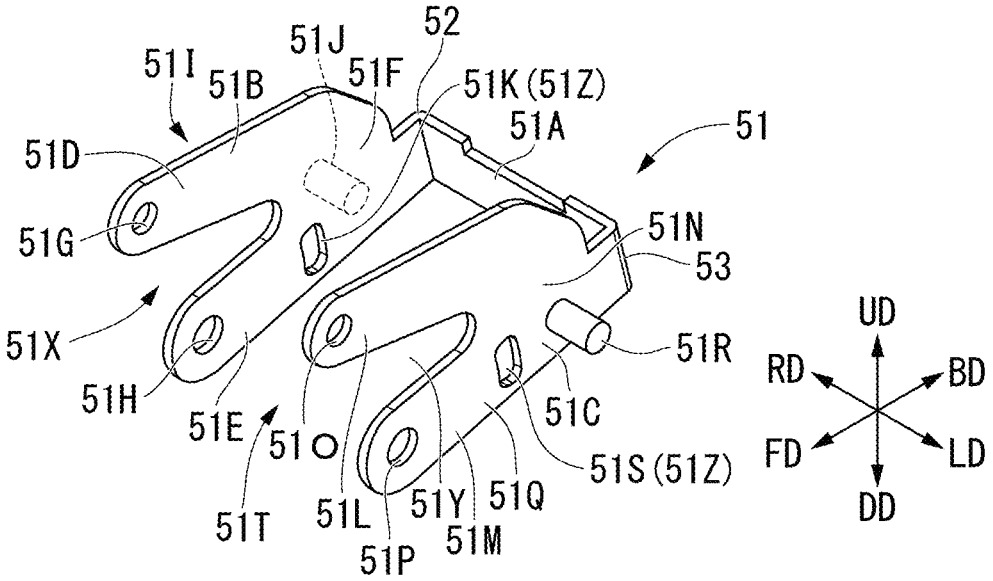
FIG. 9 A perspective view showing a support connector constituting the support structure of the chair according to one embodiment of the present invention.

As shown in FIGS. 9, 12, and 13, the support connector 51 has a connector connection plate portion 51A, a connector right plate portion 51B, and a connector left plate portion 51C.

The connector connection plate portion 51A extends parallel to the vertical directions UD and DD or to a direction inclined with respect to the vertical directions UD and DD. The connector connection plate portion 51A is connected to the connector right plate portion 51B and the connector left plate portion 51C in the left-right directions RD and LD.

The support connector 51 is rotatably supported by each of the first shaft portion 71 and the third shaft portion 73. The support connector 51 supports the arm portion 20. The support connector 51 is attachable to and detachable from the arm portion 20. The support connector 51 is an example of an "arm support portion".

The connector right plate portion 51B is a portion that extends in the forward direction FD from a right end part 52 of the connector connection plate portion 51A in the rightward direction RD. The connector right plate portion 51B has an upper right plate portion 51D, a lower right plate portion 51E, and a right connection plate portion 51F. The right connection plate portion 51F connects the upper right plate portion 51D and the lower right plate portion 51E. In the vertical directions UD and DD, the upper right plate portion 51D is positioned above the lower right plate portion 51E. A connector upper right hole 51G is formed in the upper right plate portion 51D. A connector lower right hole 51H is formed in the lower right plate portion 51E. The upper right plate portion 51D is a portion that is rotatably supported by the first shaft portion 71, and is an example of a "first connector support portion". The lower right plate portion 51E is a portion that is rotatably supported by the third shaft portion 73, and is an example of a "second connector support portion".

The connector right plate portion 51B includes the right arm engagement portion 51J formed to protrude in the rightward direction RD from a right outer surface 51I of the connector right plate portion 51B. The right arm engagement portion 51J has a circular shape in a cross section orthogonal to the left-right directions RD and LD. The right arm engagement portion 51J is an example of an "arm engagement portion". The right arm engagement portion 51J is a portion that fits into the first arm groove 27F of the first support arm 20F when the support connector 51 is connected to the first support arm 20F.

Furthermore, a right elongated hole 51K is formed in the lower right plate portion 51E. The right elongated hole 51K is positioned between the connector connection plate portion 51A and the connector lower right hole 51H in the front-rear directions FD and BD. The right elongated hole 51K extends in the vertical directions UD and DD or in a direction inclined with respect to the vertical directions UD and DD. The right elongated hole 51K is a portion into which the rotation restriction pin 75 is inserted.

The connector left plate portion 51C is a portion extending in the forward direction FD from a left end part 53 of the connector connection plate portion 51A in the leftward direction LD. The connector left plate portion 51C has an upper left plate portion 51L, a lower left plate portion 51M, and a left connection plate portion 51N. The left connection plate portion 51N connects the upper left plate portion 51L and the lower left plate portion 51M. In the vertical directions UD and DD, the upper left plate portion 51L is positioned above the lower left plate portion 51M. A connector upper left hole 51O is formed in the upper left plate portion 51L. A connector lower left hole 51P is formed in the lower left plate portion 51M. The upper left plate portion 51L is a portion that is rotatably supported by the first shaft portion 71 and is an example of a "first connector support portion". The lower left plate portion 51M is a portion that is rotatably supported by the third shaft portion 73 and is an example of a "second connector support portion".

The connector left plate portion 51C includes the left arm engagement portion 51R formed to protrude in the leftward direction LD from a left outer surface 51Q of the connector left plate portion 51C. The left arm engagement portion 51R has a circular shape in a cross section orthogonal to the left-right directions RD and LD. The left arm engagement portion 51R is an example of an "arm engagement portion". The left arm engagement portion 51R is a portion that fits into the second arm groove 27S of the second support arm 20S when the support connector 51 is connected to the second support arm 20S.

Furthermore, a left elongated hole 51S is formed in the lower left plate portion 51M. The left elongated hole 51S is positioned between the connector connection plate portion 51A and the connector lower left hole 51P in the front-rear directions FD and BD. The left elongated hole 51S extends in the vertical directions UD and DD or in a direction inclined with respect to the vertical directions UD and DD. The left elongated hole 51S is a portion into which the rotation restriction pin 75 is inserted.

The support connector 51 has a notch portion 51X formed between the upper right plate portion 51D and the lower right plate portion 51E. Similarly, a notch portion 51Y is formed between the upper left plate portion 51L and the lower left plate portion 51M. The notch portions 51X and 51Y are formed in a substantially U shape when viewed in the left-right directions RD and LD.

A connector space 51T is formed between the connector right plate portion 51B and the connector left plate portion 51C in the left-right directions RD and LD. The first seat support member 41, the second seat support member 42, the support link 55, and the support base 60 are disposed inside the connector space 51T. A distance between the connector right plate portion 51B and the connector left plate portion 51C in the left-right directions RD and LD is larger than a distance between the first right plate portion 41B and the first left plate portion 41C of the first seat support member 41.

<Support Link 55>

As shown in FIGS. 12 and 13, the shaft support mechanism 50 has two support links 55. Specifically, the shaft support mechanism 50 includes a right support link 56 positioned on a right side and a left support link 57 positioned on a left side in the left-right directions RD and LD. The right support link 56 and the left support link 57 are each a portion that is parallel to the vertical directions UD and DD or to a direction inclined with respect to the vertical directions UD and DD.

The right support link 56 extends parallel to the vertical directions UD and DD or to a direction inclined with respect to the vertical directions UD and DD. A link upper right hole 56U and a link lower right hole 56L are formed in the right support link 56. In the vertical directions UD and DD, the link upper right hole 56U is positioned above the link lower right hole 56L. The link upper right hole 56U is a portion that is rotatably supported with respect to the second shaft portion 72 and is an example of a "first link support portion". The link lower right hole 56L is a portion that is rotatably supported with respect to the fourth shaft portion 74 and is an example of a "second link support portion".

The left support link 57 extends parallel to the vertical directions UD and DD or to a direction inclined with respect to the vertical directions UD and DD. A link upper left hole 57U and a link lower left hole 57L are provided in the left support link 57. In the vertical directions UD and DD, the link upper left hole 57U is positioned above the link lower left hole 57L. The link upper left hole 57U is a portion that is rotatably supported with respect to the second shaft portion 72 and is an example of a "first link support portion". The link lower left hole 57L is a portion that is rotatably supported with respect to the fourth shaft portion 74, and is an example of a "second link support portion".

<Support Base 60>

Figure 10:
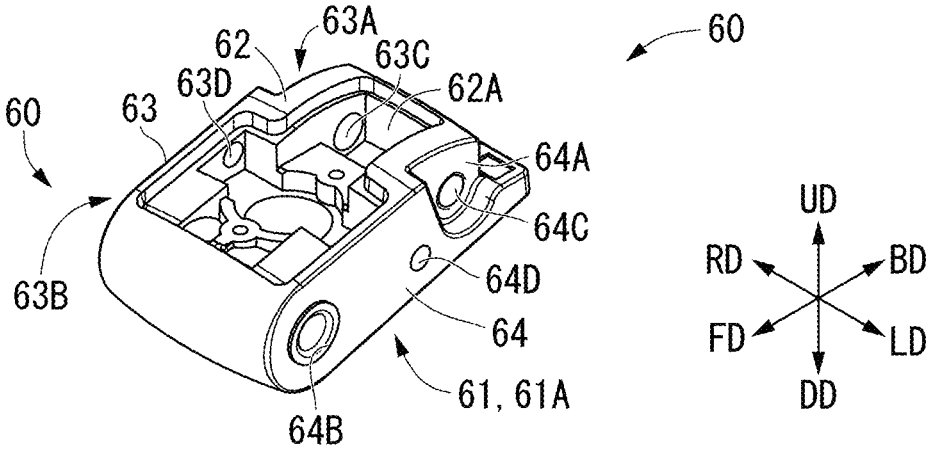
FIG. 10 A perspective view showing a support base constituting the support structure of the chair according to one embodiment of the present invention.

As shown in FIGS. 10, 12, and 13, the support base 60 has a box shape placed on an upper part of the leg portion 30.

Specifically, the box shape of the support base 60 extends parallel to the front-rear directions FD and BD or to a direction inclined with respect to the front-rear directions FD and BD, has a width in the left-right directions RD and LD, and has a thickness in the vertical directions UD and DD. The support base 60 supports the third shaft portion 73 and the fourth shaft portion 74 in a state of being placed on the upper part of the leg portion 30.

In the vertical directions UD and DD, the support base 60 has a support base lower surface 61 and a support base upper surface 62. The support base lower surface 61 forms a lower surface of the box shape. The support base upper surface 62 forms an upper surface of the box shape.

In the left-right directions RD and LD, the support base 60 has a support base right portion 63 and a support base left portion 64. The support base right portion 63 and the support base left portion 64 form two side surfaces of the box shape.

The support base lower surface 61 extends parallel to a direction inclined with respect to the front-rear directions FD and BD. The support base lower surface 61 is connected to the support base right portion 63 and the support base left portion 64. A leg connection portion 61A to which the outer cylinder 35 of the leg portion 30 is connected is provided on the support base lower surface 61. In other words, the support base 60 is supported by the leg portion 30 via the leg connection portion 61A.

A support base opening 62A that opens in the upward direction UD is formed on the support base upper surface 62. The support base cover 65 is disposed on the support base upper surface 62 to cover the support base opening 62A.

A right link support base support portion 63A is formed in the support base right portion 63. A support base right front hole 63B, a support base right rear hole 63C, and a support base right central hole 63D are formed in the support base right portion 63. The support base right rear hole 63C is formed in the right link support base support portion 63A. The right link support base support portion 63A is a portion recessed in the leftward direction LD from the support base right portion 63. The right link support base support portion 63A opens in the upward direction UD, the rearward direction BD, and the rightward direction RD. That is, the right link support base support portion 63A is a recessed portion that houses a part of the right support link 56 such that the right link support base support portion 63A is tiltable in the rearward direction BD. For example, in a state in which the right support link 56 is supported by the right link support base support portion 63A, a structure in which the right support link 56 does not protrude from the support base right portion 63 in the rightward direction RD may be employed.

In the front-rear directions FD and BD, the support base right central hole 63D is positioned between the support base right front hole 63B and the support base right rear hole 63C. The support base right front hole 63B is a portion that rotatably supports the third shaft portion 73. The support base right rear hole 63C is a portion that rotatably supports the fourth shaft portion 74. The support base right central hole 63D is a portion that supports the rotation restriction pin 75.

A left link support base support portion 64A is formed in the support base left portion 64. A support base left front hole 64B, a support base left rear hole 64C, and a support base left central hole 64D are formed in the support base left portion 64. The support base left rear hole 64C is formed in the left link support base support portion 64A. The left link support base support portion 64A is a portion recessed in the rightward direction RD from the support base left portion 64. The left link support base support portion 64A opens in the upward direction UD, the rearward direction BD, and the leftward direction LD. That is, the left link support base support portion 64A is a recessed portion that houses a part of the left support link 57 such that the left link support base support portion 64A is tiltable in the rearward direction BD. For example, in a state in which the left support link 57 is supported by the left link support base support portion 64A, a structure in which the left support link 57 does not protrude from the support base left portion 64 in the leftward direction LD may be employed.

In other words, in the left-right directions RD and LD, a distance between a recessed surface forming the right link support base support portion 63A facing the rightward direction RD and a recessed surface forming the left link support base support portion 64A facing the leftward direction LD is smaller than a distance between the support base right portion 63 and the support base left portion 64.

In the front-rear directions FD and BD, the support base left central hole 64D is positioned between the support base left front hole 64B and the support base left rear hole 64C. The support base left front hole 64B is a portion that rotatably supports the third shaft portion 73. The support base left rear hole 64C is a portion that rotatably supports the fourth shaft portion 74. The support base left central hole 64D is a portion that supports the rotation restriction pin 75.

The shaft support mechanism 50 of the leg column 33 is incorporated inside the support base 60.

Furthermore, the lock release protruding portion 32D of the gas spring 32 and a part of the pressing main body 12A of the pressing unit 12 are positioned inside the support base 60 as shown in FIG. 4. Specifically, the pressing force generation portion 12G constituting the pressing unit 12 is positioned inside the support base 60. In other words, inside the support base 60, the lock release protruding portion 32D and the pressing force generation portion 12G are slidable relative to each other.

<Support Base Cover 65>

Figure 11:
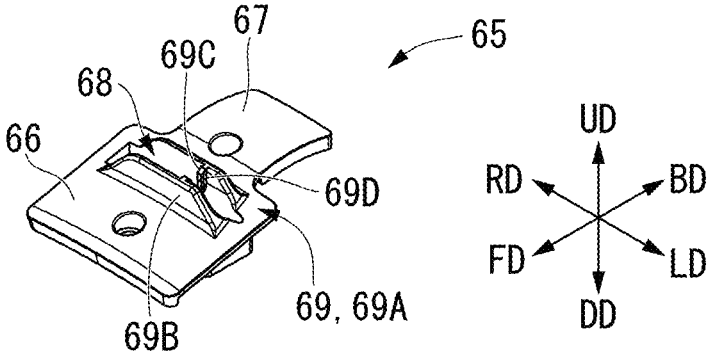
FIG. 11 A perspective view showing a support base cover constituting the support structure of the chair according to one embodiment of the present invention.

As shown in FIG. 11, the support base cover 65 has a substantially plate shape. The support base cover 65 is a member that is placed on the support base upper surface 62 to cover the support base opening 62A. The support base cover 65 has a front cover portion 66 and a rear cover portion 67. According to shapes of the right link support base support portion 63A and the left link support base support portion 64A formed in the support base 60, a width of the rear cover portion 67 in the left-right directions RD and LD is smaller than a width of the front cover portion 66. The support base cover 65 prevents an internal structure of the support base 60 from being externally exposed.

A cover opening 68 and a mechanism support portion 69 are provided on an upper surface of the front cover portion 66. The cover opening 68 penetrates the front cover portion 66. The mechanism support portion 69 includes a pressing main body support portion 69A, two side walls 69B, an outer tube fixing portion 69C, and an inner wire insertion portion 69D. The pressing main body support portion 69A is provided between the two side walls 69B. The pressing main body support portion 69A is a portion that supports the pressing support shaft 12B of the pressing unit 12.

That is, in a state in which the support base cover 65 attached to the support base 60, the support base cover 65 rotatably supports the pressing unit 12.

In a state in which the pressing support shaft 12B is supported by the pressing main body support portion 69A, a part of the pressing unit 12 is exposed to a space above the front cover portion 66 through the cover opening 68. When viewed in the front-rear directions FD and BD, the pressing main body support portion 69A overlaps the two side walls 69B. That is, when viewed in the front-rear directions FD and BD, the two side walls 69B prevent the pressing main body support portion 69A from being exposed.

The outer tube fixing portion 69C is provided between the two side walls 69B. The outer tube fixing portion 69C is a portion fixing an end part of the outer tube 11A shown in FIG. 4. Therefore, the outer tube is maintained in a state in which it does not move away from the support base cover 65.

The inner wire insertion portion 69D is provided between the two side walls 69B. The inner wire insertion portion 69D is a recessed portion or a hole through which the inner wire 11B passes. The inner wire 11B is capable of moving relative to the outer tube 11A through the inner wire insertion portion 69D.

That is, the support base cover 65 not only prevents the internal structure of the support base 60 from being externally exposed, but also constitutes a part of the support mechanism for the wire structure 11 and the pressing unit 12.

<First Shaft Portion 71, Second Shaft Portion 72, Third Shaft Portion 73, Fourth Shaft Portion 74, and Rotation Restriction Pin 75>

As shown in FIG. 5, the first shaft portion 71, the second shaft portion 72, the third shaft portion 73, the fourth shaft portion 74, and the rotation restriction pin 75 each extend in the left-right directions RD and LD. Each of these shafts and pin is, for example, a shaft made of a known solid rod-shaped member. A hole is formed at each of portions that are rotatably connected to the four shaft portions. A bearing may be disposed between each of the four shaft portions and the hole. The four shaft portions are each formed of, for example, a known metal rod. Types of material or diameters of the metal rod forming the four shaft portions are not particularly limited as long as the strength member is configured to have a sufficient strength to support the occupant seated on the seat 1.

In the present embodiment, a case in which the first shaft portion 71, the second shaft portion 72, the third shaft portion 73, the fourth shaft portion 74, and the rotation restriction pin 75 are each a solid rod-shaped member has been described. The shafts and pin described above are not limited to a solid rod-shaped member. For example, a hollow rod-shaped member may be applied to the shafts and pin described above.

<Specific Configuration of Shaft Support Mechanism 50>

A specific configuration and operation of the shaft support mechanism 50 will be described with reference to FIGS. 5, 6, 9, 12, and 13. In FIGS. 12 and 13, the seat support member 40 fixed to the seat 1 is shown, but the seat 1 is omitted. FIG. 12 shows a state in which the back support portion 21 is at the front limit position 81 within a tilt range 80 of the back support portion 21. FIG. 13 shows a state in which the back support portion 21 is at a rear limit position 82 within the tilt range 80 of the back support portion 21.

<Support Structure by First Shaft Portion 71>

In a direction in which the first shaft portion 71 extends, the upper left plate portion 51L of the support connector 51, the first left plate portion 41C of the first seat support member 41, the second left plate portion 42C of the second seat support member 42, the second right plate portion 42B of the second seat support member 42, the first right plate portion 41B of the first seat support member 41, and the upper right plate portion 51D of the support connector 51 are aligned in that order from the upper left plate portion 51L of the support connector 51 toward the rightward direction RD.

Of the above-described members supported by the first shaft portion 71, two adjacent members may be spaced apart not to come into contact with each other. For example, a spacer such as a resin may be disposed between the two members.

The first shaft portion 71 passes through the first right front hole 41G and the first left front hole 41I of the first seat support member 41, the second right front hole 42G and the second left front hole 42I of the second seat support member 42, and the connector upper right hole 51G and the connector upper left hole 51O of the support connector 51. In order to prevent the first shaft portion 71 from falling off from these six holes, for example, C-rings may be engaged with both ends of the first shaft portion 71 in the left-right directions RD and LD. Also, a large diameter portion having a diameter larger than diameters of the six holes may be provided at one end of the first shaft portion 71, and a C-ring may be engaged with the other end of the first shaft portion 71. A structure for preventing the first shaft portion 71 from falling off is not particularly limited.

As a structure for preventing the first shaft portion 71 from falling off, for example, a structure using rivets may be employed. That is, one side of the first shaft portion 71 has a head portion, and the other side of the first shaft portion 71 has a straight portion. In this case, a diameter of the head portion is larger than a diameter of the hole through which the first shaft portion 71 is inserted. Specifically, after the straight portion of the first shaft portion 71 is passed through the hole, the straight portion is plastically deformed by swaging the straight portion. Therefore, a large diameter portion is formed on a side of the first shaft portion 71 opposite to the head portion. A diameter of the large diameter portion is larger than a diameter of the hole through which the first shaft portion 71 is inserted.

The first shaft portion 71 is a single rod-shaped member passing through the six holes described above. The first shaft portion 71 does not necessarily have to be a single rod-shaped member. The first shaft portion 71 may be configured by a pair of shaft portions that share a common axis while being separate from each other. In this case, one of the pair of shaft portions passes through the first right front hole 41G of the first seat support member 41, the second right front hole 42G of the second seat support member 42, and the connector upper right hole 51G of the support connector 51. The other of the pair of shaft portions passes through the first left front hole 41I of the first seat support member 41, the second left front hole 42I of the second seat support member 42, and the connector upper left hole 51O of the support connector 51.

The first shaft portion 71 rotatably supports the seat support member 40 fixed to the seat 1.

The first shaft portion 71 rotatably supports the support connector 51 independently of the seat support member 40. In other words, the seat support member 40 and the support connector 51 are relatively rotatable around the first shaft portion 71.

The first shaft portion 71 moves in the front-rear directions FD and BD in accordance with movement of the seat 1 in the front-rear directions FD and BD.

<Support Structure by Second Shaft Portion 72>

In a direction in which the second shaft portion 72 extends, the left support link 57, the first left plate portion 41C of the first seat support member 41, the second left plate portion 42C of the second seat support member 42, the second right plate portion 42B of the second seat support member 42, the first right plate portion 41B of the first seat support member 41, and the right support link 56 are aligned in that order from the left support link 57 toward the rightward direction RD.

Of the above-described members supported by the second shaft portion 72, two adjacent members may be spaced apart not to come into contact with each other. For example, a spacer such as a resin may be disposed between the two members.

The second shaft portion 72 passes through the first right rear hole 41H and the first left rear hole 41J of the first seat support member 41, the second right rear hole 42H and the second left rear hole 42J of the second seat support member 42, the link upper right hole 56U of the right support link 56, and the link upper left hole 57U of the left support link 57. In order to prevent the second shaft portion 72 from falling off from these six holes, for example, C-rings may be engaged with both ends of the second shaft portion 72 in the left-right directions RD and LD. Also, a large diameter portion having a diameter larger than diameters of the six holes may be provided at one end of the second shaft portion 72, and a C-ring may be engaged with the other end of the second shaft portion 72. A structure for preventing the second shaft portion 72 from falling off is not particularly limited.

As a structure for preventing the second shaft portion 72 from falling off, for example, a structure using rivets may be employed. That is, one side of the second shaft portion 72 has a head portion, and the other side of the second shaft portion 72 has a straight portion. In this case, a diameter of the head portion is larger than a diameter of the hole through which the second shaft portion 72 is inserted. Specifically, after the straight portion of the second shaft portion 72 is passed through the hole, the straight portion is plastically deformed by swaging the straight portion. Therefore, a large diameter portion is formed on a side of the second shaft portion 72 opposite to the head portion. A diameter of the large diameter portion is larger than a diameter of the hole through which the second shaft portion 72 is inserted.

The second shaft portion 72 is a single rod-shaped member passing through the six holes described above. The second shaft portion 72 does not necessarily have to be a single rod-shaped member. The second shaft portion 72 may be configured by a pair of shaft portions that share a common axis while being separate from each other. In this case, one of the pair of shaft portions passes through the first right rear hole 41H of the first seat support member 41, the second right rear hole 42H of the second seat support member 42, and the link upper right hole 56U of the right support link 56. The other of the pair of shaft portions passes through the first left rear hole 41J of the first seat support member 41, the second left rear hole 42J of the second seat support member 42, and the link upper left hole 57U of the left support link 57.

The second shaft portion 72 rotatably supports the seat support member 40 fixed to the seat 1.

The second shaft portion 72 rotatably supports the support link 55 independently of the seat support member 40. In other words, the seat support member 40 and the support link 55 are relatively rotatable around the second shaft portion 72.

The second shaft portion 72 moves in the front-rear directions FD and BD in accordance with movement of the seat 1 in the front-rear directions FD and BD.

<Support Structure by Third Shaft Portion 73>

In a direction in which the third shaft portion 73 extends, the second support arm 20S, the lower left plate portion 51M of the support connector 51, the support base left portion 64, the support base right portion 63, the lower right plate portion 51E of the support connector 51, and the first support arm 20F are aligned in that order from the second support arm 20S toward the rightward direction RD.

Of the above-described members supported by the third shaft portion 73, two adjacent members may be spaced apart not to come into contact with each other. For example, a spacer such as a resin may be disposed between the two members.

The third shaft portion 73 is statically supported by the support base 60.

The third shaft portion 73 passes through the first shaft support hole 26F of the first support arm 20F, the second shaft support hole 26S of the second support arm 20S, the connector lower right hole 51H and the connector lower left hole 51P of the support connector 51, and the support base right front hole 63B and support base left front hole 64B of the support base 60. The third shaft portion 73 is fastened to the first support arm 20F and the second support arm 20S using fastening members such as bolts which are not shown in the drawings.

The third shaft portion 73 is a single rod-shaped member passing through the six holes described above. The third shaft portion 73 does not necessarily have to be a single rod-shaped member. The third shaft portion 73 may be configured by a pair of shaft portions that share a common axis while being separate from each other. In this case, one of the pair of shaft portions passes through the first shaft support hole 26F of the first support arm 20F, the connector lower right hole 51H of the support connector 51, and the support base right front hole 63B of the support base 60. The other of the pair of shaft portions passes through the second shaft support hole 26S of the second support arm 20S, the connector lower left hole 51P of the support connector 51, and the support base left front hole 64B of the support base 60.

The third shaft portion 73 rotatably supports the support connector 51 and the horizontal arm 20B with respect to the support base 60. Therefore, the support connector 51 is tiltable around the third shaft portion 73 in the front-rear directions FD and BD in conjunction with the rotation of the arm portion 20.

Furthermore, the third shaft portion 73 is positioned below the first shaft portion 71 in the vertical directions UD and DD.

<Support Structure by Fourth Shaft Portion 74>

In a direction in which the fourth shaft portion 74 extends, the left support link 57, the left link support base support portion 64A of the support base 60, the right link support base support portion 63A of the support base 60, and the right support link 56 are aligned in that order in the rightward direction RD from the left support link 57.

Of the above-described members supported by the fourth shaft portion 74, two adjacent members may be spaced apart not to come into contact with each other. For example, a spacer such as a resin may be disposed between the two members.

The fourth shaft portion 74 is statically supported by the support base 60.

The fourth shaft portion 74 passes through the link lower right hole 56L of the right support link 56, the link lower left hole 57L of the left support link 57, and the support base right rear hole 63C and support base left rear hole 64C of the support base 60. In order to prevent the fourth shaft portion 74 from falling off from these four holes, for example, C-rings may be engaged with both ends of the fourth shaft portion 74 in the left-right directions RD and LD. Also, a large diameter portion having a diameter larger than diameters of the four holes may be provided at one end of the fourth shaft portion 74, and a C-ring may be engaged with the other end of the fourth shaft portion 74. A structure for preventing the fourth shaft portion 74 from falling off is not particularly limited.

As a structure for preventing the fourth shaft portion 74 from falling off, for example, a structure using rivets may be employed. That is, one side of the fourth shaft portion 74 has a head portion, and the other side of the fourth shaft portion 74 has a straight portion. In this case, a diameter of the head portion is larger than a diameter of the hole through which the fourth shaft portion 74 is inserted. Specifically, after the straight portion of the fourth shaft portion 74 is passed through the hole, the straight portion is plastically deformed by swaging the straight portion. Therefore, a large diameter portion is formed on a side of the fourth shaft portion 74 opposite to the head portion. A diameter of the large diameter portion is larger than the diameter of the hole through which the fourth shaft portion 74 is inserted.

The fourth shaft portion 74 is a single rod-shaped member passing through the four holes described above. The fourth shaft portion 74 does not necessarily have to be a single rod-shaped member. The fourth shaft portion 74 may be configured by a pair of shaft portions that share a common axis while being separate from each other. In this case, one of the pair of shaft portions passes through the link lower right hole 56L of the right support link 56 and the support base right rear hole 63C of the support base 60. The other of the pair of shaft portions passes through the link lower left hole 57L of the left support link 57 and the support base left rear hole 64C of the support base 60.

The fourth shaft portion 74 rotatably supports the right support link 56 and the left support link 57 with respect to the support base 60. In other words, the support link 55 is rotatable around the fourth shaft portion 74 such that an inclination between a direction in which the support link 55 extends and the vertical directions UD and DD varies. Furthermore, the fourth shaft portion 74 is positioned behind the third shaft portion 73 in the front-rear directions FD and BD.

<Rotation Restriction Pin 75>

The rotation restriction pin 75 is statically supported by the support base 60. Specifically, the rotation restriction pin 75 passes through the support base right central hole 63D and support base left central hole 64D of the support base 60, the right elongated hole 51K of the connector right plate portion 51B, and the left elongated hole 51S of the connector left plate portion 51C. In order to prevent the rotation restriction pin 75 from falling off from these four holes, for example, C-rings may be engaged with both ends of the rotation restriction pin 75 in the left-right directions RD and LD. Also, a large diameter portion having a diameter larger than diameters of the four holes may be provided at one end of the rotation restriction pin 75, and a C-ring may be engaged with the other end of the rotation restriction pin 75. A structure for preventing the rotation restriction pin 75 from falling off is not particularly limited. In the following description, the right elongated hole 51K and the left elongated hole 51S may be simply referred to as an elongated hole 51Z.

The tilt range 80 of the back support portion 21 in the front-rear directions FD and BD is determined by a shape of the elongated hole 51Z in the vertical directions UD and DD. In other words, as the support connector 51 rotates, a position of the rotation restriction pin 75 with respect to the elongated hole 51Z changes. For example, as shown in FIG. 12, when the rotation restriction pin 75 is positioned at a lower part of the elongated hole 51Z, the back support portion 21 is at the front limit position 81 within the tilt range 80. Conversely, as shown in FIG. 13, when the rotation restriction pin 75 is positioned at an upper part of the elongated hole 51Z, the back support portion 21 is at a rear position within the tilt range 80. In this manner, the tilt range 80 of the back support portion 21 is defined by the elongated hole 51Z.

<Connection Structure Between Support Connector 51 and Arm Portion 20>

As shown in FIGS. 5, 6, and 9, the right arm engagement portion 51J of the support connector 51 is fitted into the first arm groove 27F of the first support arm 20F. Similarly, the left arm engagement portion 51R of the support connector 51 is fitted into the second arm groove 27S of the second support arm 20S. Therefore, the support connector 51 is connected to the arm portion 20.

In such a connection structure, a position of the first shaft support hole 26F coincides with a position of the connector lower right hole 51H, and a position of the second shaft support hole 26S coincides with a position of the connector lower left hole 51P.

<Method of Connecting Support Connector 51 and Arm Portion 20>

Figure 14A:
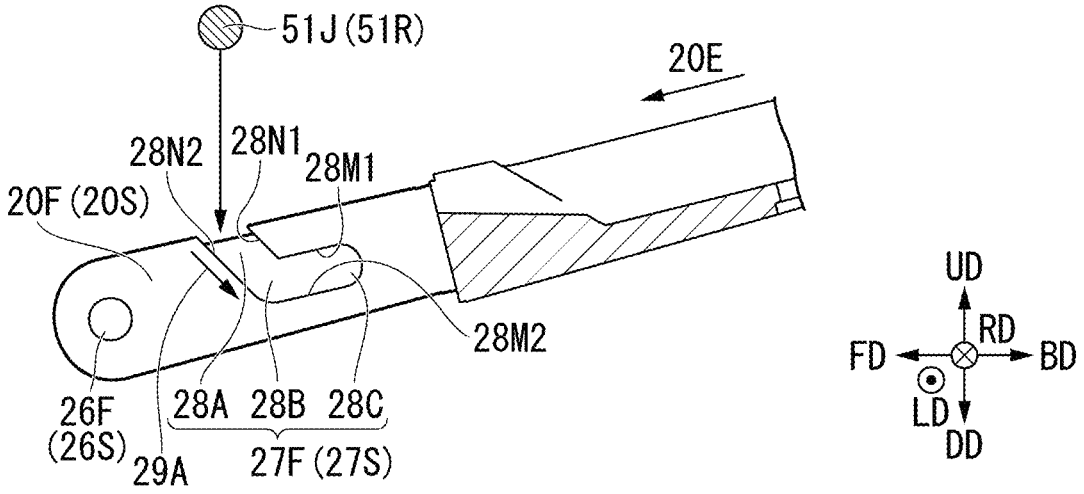
FIG. 14A A side view showing a method of connecting the arm portion constituting the backrest and the support connector constituting the support structure of the chair according to one embodiment of the present invention.
Figure 14B:
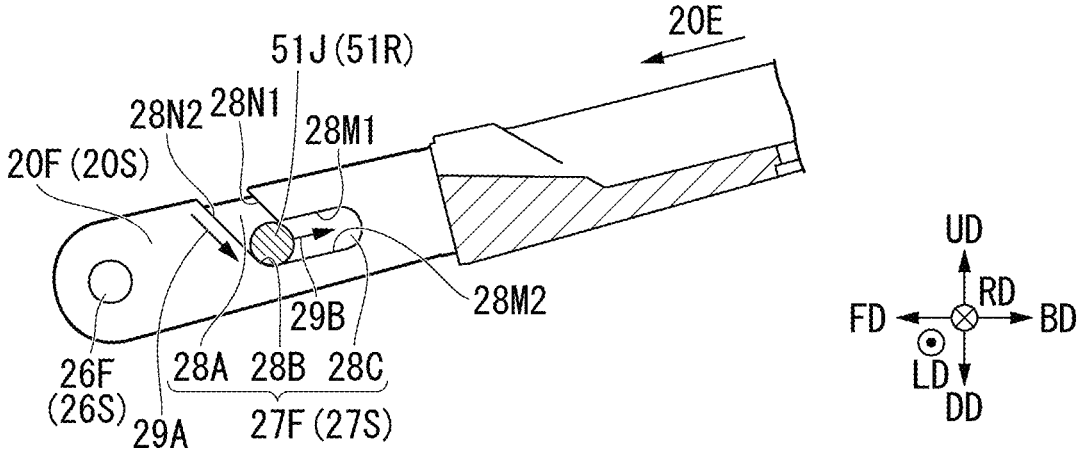
FIG. 14B A side view showing a method of connecting the arm portion constituting the backrest and the support connector constituting the support structure of the chair according to one embodiment of the present invention.

Next, a method of connecting the arm portion 20 and the support connector 51 will be described with reference to FIGS. 6, 14A, and 14B. FIGS. 14A and 14B correspond to FIG. 6. In the example shown in FIGS. 14A and 14B, the extension direction 20E in which the first support arm 20F extends is inclined with respect to the front-rear directions FD and BD, but the extension direction 20E may not necessarily have to be inclined with respect to the front-rear directions FD and BD. As long as the support connector 51 can be easily connected to the arm portion 20, the extension direction 20E may be parallel to the front-rear directions FD and BD, or parallel to the vertical directions UD and DD.

First, as shown in FIG. 14A, while the support connector 51 is inserted into the space between the first support arm 20F and the second support arm 20S, the right arm engagement portion 51J is inserted into the oblique opening groove 28A of the first arm groove 27F and the left arm engagement portion 51R is inserted into the oblique opening groove 28A of the second arm groove 27S.

The right arm engagement portion 51J moves within the oblique opening groove 28A of the first support arm 20F in the groove inclination direction 29A. Inside the oblique opening groove 28A, the right arm engagement portion 51J moves inside the oblique opening groove 28A while facing both the two oblique groove walls 28N1 and 28N2. The right arm engagement portion 51J may come into contact with each of the two oblique groove walls 28N1 and 28N2. That is, both the two oblique groove walls 28N1 and 28N2 guide the right arm engagement portion 51J, restrict a movement direction of the right arm engagement portion 51J, and move the right arm engagement portion 51J in the groove inclination direction 29A. Thereafter, the right arm engagement portion 51J reaches an end part of the oblique opening groove 28A in the groove inclination direction 29A, that is, the front-rear extending groove 28B of the first support arm 20F.

At the same timing as the movement of the right arm engagement portion 51J in the oblique opening groove 28A, the left arm engagement portion 51R moves within the oblique opening groove 28A of the second support arm 20S in the groove inclination direction 29A. Inside the oblique opening groove 28A, the left arm engagement portion 51R moves inside the oblique opening groove 28A while facing both the two oblique groove walls 28N1 and 28N2. The right arm engagement portion 51J may come into contact with each of the two oblique groove walls 28N1 and 28N2. That is, both the two oblique groove walls 28N1 and 28N2 guide the left arm engagement portion 51R, restrict a movement direction of the left arm engagement portion 51R, and move the left arm engagement portion 51R in the groove inclination direction 29A. Thereafter, the left arm engagement portion 51R reaches an end part of the oblique opening groove 28A in the groove inclination direction 29A, that is, the front-rear extending groove 28B of the second support arm 20S.

Next, the right arm engagement portion 51J moves within the front-rear extending groove 28B of the first support arm 20F in the groove extension direction 29B. Inside the front-rear extending groove 28B, the right arm engagement portion 51J moves inside the front-rear extending groove 28B while facing both the two extending groove walls 28M1 and 28M2. The right arm engagement portion 51J may come into contact with each of the two extending groove walls 28M1 and 28M2. That is, both the two extending groove walls 28M1 and 28M2 guide the right arm engagement portion 51J, restrict a movement direction of the right arm engagement portion 51J, and move the right arm engagement portion 51J in the groove extension direction 29B. Thereafter, the right arm engagement portion 51J reaches an end part of the front-rear extending groove 28B in the groove extension direction 29B, that is, the groove depth portion 28C of the first support arm 20F as shown in FIG. 6. In a state in which the right arm engagement portion 51J is in contact with the groove depth portion 28C of the first support arm 20F, the right arm engagement portion 51J and the first support arm 20F are positioned. In other words, the support connector 51 and the first support arm 20F are connected. In this state, the first shaft support hole 26F of the first support arm 20F and the third shaft portion 73 are fixed. Therefore, the first support arm 20F is rotatable around the third shaft portion 73.

At the same timing as the movement of the left arm engagement portion 51R in the front-rear extending groove 28B, the left arm engagement portion 51R moves within the front-rear extending groove 28B of the second support arm 20S in the groove extension direction 29B. Inside the front-rear extending groove 28B, the left arm engagement portion 51R moves inside the front-rear extending groove 28B while facing both the two extending groove walls 28M1 and 28M2. The left arm engagement portion 51R may come into contact with each of the two extending groove walls 28M1 and 28M2. That is, both the two extending groove walls 28M1 and 28M2 guide the left arm engagement portion 51R, restrict a movement direction of the left arm engagement portion 51R, and move the left arm engagement portion 51R in the groove extension direction 29B. Thereafter, the left arm engagement portion 51R reaches an end part of the front-rear extending groove 28B in the groove extension direction 29B, that is, the groove depth portion 28C of the second support arm 20S as shown in FIG. 6. In a state in which the left arm engagement portion 51R is in contact with the groove depth portion 28C of the second support arm 20S, the left arm engagement portion 51R and the second support arm 20S are positioned. In other words, the support connector 51 and the second support arm 20S are connected. In this state, the second shaft support hole 26S of the second support arm 20S and the third shaft portion 73 are fixed. Therefore, the second support arm 20S is rotatable around the third shaft portion 73.

In this way, once a positional relationship between the arm portion 20 and the support connector 51 in the front-rear directions FD and BD and the vertical directions UD and DD is determined, a positional relationship between the elastic member support portion 24 integrated with the arm portion and the seat support member 40 supported by the support connector 51 in the front-rear directions FD and BD and the vertical directions UD and DD is determined. In this state, the elastic member 23 is connected to the elastic member support portion 24 and the seat support member 40. At this time, it is preferable that a shape of the elastic member 23 be set such that an initial reaction force is generated in the elastic member 23. For example, it is preferable that a shape of the elastic member 23 be set such that an angle formed between the vertical spring portion 23A and the horizontal spring portion 23B, which form an L shape in a side view, changes.

In other words, in a state in which assembly of the arm portion 20 and the support connector 51 is completed, the elastic member 23 can be attached to the arm portion 20. In this case, since deformation (initial reaction force) occurs in the elastic member 23, the elastic member 23 can be desirably attached to the arm portion 20.

When the above-described connection method is used, the arm portion 20 having the first support arm 20F and the second support arm 20S can be connected to the support connector 51. Conversely, the support connector 51 can be removed from the arm portion 20 by releasing the fixed state of the first shaft support hole 26F and the second shaft support hole 26S with respect to the third shaft portion 73, removing the right arm engagement portion 51J from the first arm groove 27F, and removing the left arm engagement portion 51R from the second arm groove 27S.

That is, in the above-described connection structure, the support connector 51 is attachable to and detachable from the arm portion 20.

<Distance Relationship Between First Shaft Portion 71, Second Shaft Portion 72, Third Shaft Portion 73, and Fourth Shaft Portion 74>

In a direction from the first shaft portion 71 toward the third shaft portion 73, a distance between the first shaft portion 71 and the third shaft portion 73 is defined as a first distance L1.

In a direction from the second shaft portion 72 toward the fourth shaft portion 74, a distance between the second shaft portion 72 and the fourth shaft portion 74 is defined as a second distance L2. Here, the first distance L1 is larger than the second distance L2.

<Positional Relationship of Support Link 55 with Respect to First Shaft Portion 71 and Third Shaft Portion 73>

The support link 55 having such a configuration is positioned behind the first shaft portion 71 and the third shaft portion 73 in the front-rear directions FD and BD. In other words, the support link 55 is positioned between the first shaft portion 71 and the back support portion 21 or between the third shaft portion 73 and the back support portion 21.

<Operation in Support Structure 3>

In the chair 100 according to the above-described aspect, when the occupant pushes the back support portion 21 in the rearward direction BD with his/her back in a state in which the occupant is seated on the seat 1, the arm portion 20 rotates around the third shaft portion 73 in conjunction with movement of the back support portion 21. As the arm portion 20 rotates, the support connector 51 supporting the arm portion 20 also rotates around the third shaft portion 73. As the support connector 51 rotates, the support connector 51 supporting the arm portion 20 also rotates around the third shaft portion 73. The first shaft portion 71 supported by the support connector 51 moves in the rearward direction BD while rotating around the third shaft portion 73. The seat 1 supported by the first shaft portion 71 moves in the rearward direction BD. As the seat 1 moves, the second shaft portion 72 rotatably supporting the seat 1 also moves in the rearward direction BD. The second shaft portion 72 is rotatably supported by the support link. The support link rotates around the fourth shaft portion 74. That is, the second shaft portion 72 moves in the rearward direction BD while rotating around the fourth shaft portion 74. Therefore, the seat 1, which is supported by the first shaft portion 71 and the second shaft portion 72, moves in the rearward direction BD along a trajectory that is a combination of rotation around the third shaft portion 73 by the support connector 51 and rotation around the fourth shaft portion 74 by the support link. At this time, the support base 60 supporting the third shaft portion 73 and the fourth shaft portion 74 does not move in the front-rear directions FD and BD. In other words, the seat 1, the first shaft portion 71, and the second shaft portion 72 move in the rearward direction BD relative to the support base 60.

According to the chair 100 of the present embodiment, when the occupant pushes the back support portion 21 in the rearward direction BD, the back support portion 21 tilts in the vertical directions UD and DD, and as the back support portion 21 tilts, the seat 1 can be moved in the rearward direction BD with respect to the support base 60, that is, the seat 1 can be directly pulled in the rearward direction BD.

Furthermore, since the support link 55 is positioned in the rearward direction BD from the first shaft portion 71 and the third shaft portion 73 in the front-rear directions FD and BD, there is no need to dispose the support link 55 forward in the front-rear directions FD and BD. Therefore, the support structure 3 can be made smaller in size, a space at the front in the front-rear directions FD and BD in a space of the seat 1 in which the seat plate lower surface 4L is exposed can be increased, and a space occupied by the support structure 3 disposed on the seat plate lower surface 4L of the seat 1 can be reduced. That is, a large space can be secured on the seat plate lower surface 4L of the seat 1, and design quality of the chair 100 can be enhanced.

Also, the seat 1 is rotatably supported by the second shaft portion 72 that is positioned in the rearward direction BD from the first shaft portion 71. The second shaft portion 72 is not directly connected to the backrest 2 but is supported by the support link 55. Therefore, a state is brought about in which a range of downward movement of the second shaft portion 72 is restricted. In other words, a rotation range of the support link 55 is restricted, and thereby the range of downward movement of the second shaft portion 72 is restricted. Also, since a height of the support link 55 is also restricted, the range of downward movement of the second shaft portion 72 is restricted. In a state in which movement of the second shaft portion 72 is restricted as described above, the second shaft portion 72 is supported to be tiltable in the rearward direction BD and the downward direction DD. Therefore, tilting of the seat 1 in the rearward direction BD and the downward direction DD is not affected by the tilting of the backrest 2. Therefore, when the height of the support link 55 and the rotation range of the support link 55 are appropriately set, an amount of tilt of the support link 55 in the rearward direction BD and downward direction DD of the seat 1 becoming excessive can be suppressed.

According to the chair 100 of the present embodiment, the support link 55 remains in a state in which it is not inclined in the rearward direction BD when the back support portion 21 is at the front limit position 81. Therefore, even when the back support portion 21 reaches the rear limit position 82, an amount of movement of the support link 55 in the rearward direction BD and the downward direction DD can be reduced. The amount of tilt of the support link 55 in the rearward direction BD and downward direction DD of the seat 1 becoming excessive can be suppressed.

According to the chair 100 of the present embodiment, since the first distance L1 is larger than the second distance L2, the amount of tilt of the support link 55 in the rearward direction BD and downward direction DD of the seat 1 becoming excessive can be suppressed.

According to the chair 100 of the present embodiment, since a position of the second shaft portion 72 is higher than a position of the third shaft portion 73 in the vertical directions UD and DD, the amount of tilt of the support link 55 in the rearward direction BD and downward direction DD of the seat 1 becoming excessive can be suppressed.

According to the chair 100 of the present embodiment, the seat 1 includes the support mechanism housing portion 6 provided on the seat plate lower surface 4L. The first shaft portion 71 and the second shaft portion 72 are housed inside the support mechanism housing portion 6. Therefore, when viewed in the front-rear directions FD and BD and the left-right directions RD and LD, the first shaft portion 71 and the second shaft portion 72 are not exposed to the outside of the support mechanism housing portion 6. Therefore, design quality can be enhanced in terms of an appearance of the chair 100.

According to the chair 100 of the present embodiment, the seat 1 includes the seat main body 4 having the seat plate lower surface 4L on which the support mechanism housing portion 6 is formed. The support structure 3 includes the seat support member 40 housed inside the support mechanism housing portion 6. The seat support member 40 supports the first shaft portion 71 and the second shaft portion 72, and when viewed in the left-right directions RD and LD, the seat support member 40 overlaps the seat main body 4. That is, the depth 6D of the support mechanism housing portion 6 is larger than the height 40H of the seat support member 40. Therefore, when viewed in the front-rear directions FD and BD and the left-right directions RD and LD, the seat support member 40 supporting the first shaft portion 71 and the second shaft portion 72 is not exposed to the outside of the support mechanism housing portion 6. Therefore, design quality can be enhanced in terms of an appearance of the chair 100.

Furthermore, in assembly work of the above-described components constituting the chair 100, the backrest 2 and the seat support member 40 can first be pivotally supported relative to each other, and then work of housing the seat support member 40 in the seat main body 4 can be performed. Therefore, the assembly work can be easily performed.

According to the chair 100 of the present embodiment, the notch portions 51X and 51Y are formed in the support connector 51. Therefore, a large space can be secured below the seat 1 and the design quality can be enhanced.

<Method of Adjusting Height of Seat 1 Using Operation Mechanism 5>

Next, a method of adjusting a height of the seat 1 using the operation mechanism 5 will be described.

The method of adjusting the height of the seat 1 is performed through the following steps.

[1] Step 1: Releasing a locked state of the gas spring 32 due to rotation of the lever 10D by the occupant

[2] Step 2: Lowering the seat in the downward direction DD or raising the seat in the upward direction UD

[3] Step 3: Fixing the position of the seat

Next, steps 1 to 3 above will be described in order.

<Step 1>

First, in an initial state of the chair 100, a position of the seat 1 is fixed. Specifically, in the gas spring 32 constituting the chair 100, the lock release protruding portion 32D is not pressed. Therefore, the lock mechanism 32C fixes a position of the piston 32B in the vertical directions UD and DD, that is, the position of the seat 1 is fixed. In this state, step 1 is performed.

The occupant, while seated on the chair 100, moves the lever 10D shown in FIG. 3 in a rotation operation direction 85 with his/her fingers. Therefore, the lever 10D rotates around the lever support shaft 10A, and the wire support portion 10C of the lever plate 10B rotates in the rotation operation direction 85. At this time, a moment based on the principle of leverage is generated, and a force larger than a force applied to the lever 10D by the occupant acts on the wire support portion 10C. This force acts on the first wire engaging end 11F connected to the wire support portion 10C and on the inner wire 11B connected to the first wire engaging end 11F, causing the inner wire 11B to move in a tensile direction 86.

As shown in FIG. 4, the second wire engaging end 11S connected to the inner wire 11B moves in the tensile direction 86 in accordance with the movement of the inner wire 11B. Furthermore, the pressing engagement portion 12C engaged with the second wire engaging end 11S moves in the tensile direction 86. Therefore, the pressing force generation portion 12G rotates in a rotation pressing direction 87 around the pressing support shaft 12B. At this time, a moment based on the principle of leverage is generated, and a force larger than a tensile force applied to the inner wire 11B in the tensile direction 86 acts on the pressing force generation portion 12G. This force presses the lock release protruding portion 32D of the gas spring 32 in the downward direction DD. Therefore, a locked state of the gas spring 32 is released.

<Step 2>

When the lock release protruding portion 32D is pressed, a fixed state at a position of the lock mechanism 32C is released. When the fixed state at the position of the lock mechanism 32C is released, an upward force that moves the piston 32B in the upward direction UD is generated by an action of a compressed gas filled in the cylinder 32A of the gas spring 32. In this state, the occupant adjusts a height of the seat 1.

To lower the seat 1 in the downward direction DD, the occupant presses the seat 1 downward in the downward direction DD using his/her body weight or the like. Specifically, the seat 1 can be easily lowered by making the pressing force greater than the upward force of the gas spring 32.

To raise the seat 1 in the upward direction UD, the occupant can easily raise the seat 1 by utilizing the upward force of the gas spring 32 without applying any force to the seat 1.

<Step 3>

An operator releases rotation of the lever 10D in the rotation operation direction 85. Therefore, the pressing state of the lock release protruding portion 32D is released. The lock mechanism 32C fixes the piston 32B in the gas spring 32. Therefore, the position of the seat 1 is fixed.

<Effects Obtained by Operation Mechanism 5>

In the chair 100 including the above-described operation mechanism 5, an operation of the gas spring 32 can be performed using the wire structure 11. That is, a conventional operation using a rod is no longer necessary. Particularly, since the wire structure 11 having flexibility is used, even if there are essential members constituting the chair 100 in a layout of the members disposed on the seat plate lower surface 4L, a position of the wire structure 11 can be freely set to avoid these essential members. That is, regarding the layout on the seat plate lower surface 4L, a degree of freedom in disposing the lever 10D is increased.

Furthermore, the moment based on the principle of leverage is generated at two locations. Therefore, the occupant can easily perform height adjustment of the gas spring 32 with a small amount of force.

Conventionally, a locked state of the gas spring was released and a height of the seat was adjusted by pulling up a rod positioned below the plate lower surface. For example, when the position of the seat is lowered, a direction in which the rod is pulled up is different from a vertical direction in which the seat moves. Therefore, there is a problem in that operability is low.

In contrast, according to the present embodiment, the rotation operation direction 85 of the lever 10D is the horizontal direction. That is, when the lever 10D is moved in a direction orthogonal to the vertical directions UD and DD of the seat 1, the force generated by the horizontally operated lever 10D can be transmitted to the gas spring 32 by utilizing the moment generated at two locations, thereby adjusting the height of the seat 1.

Also, in the conventional structure using a rod, the rod protrudes from the support structure 3 in the left-right directions RD and LD. In this case, there is a problem in that design quality of the chair 100 decreases.

In contrast, according to the present embodiment, since no rod is used, design quality of the chair 100 when viewed from the left-right directions RD and LD can be enhanced.

Also, in the conventional structure using a rod, the rod spaced apart from the seat plate lower surface 4L is operated. Therefore, when the occupant operates the rod, he or she must extend his or her fingers into a space below the seat plate lower surface 4L and feel around to confirm a position of the rod. Therefore, operability is low.

In contrast, according to the present embodiment, when the lever 10D is operated, the occupant confirms a position of the lever 10D while touching a shape of the seat plate lower surface 4L with his or her fingers and then operates the lever 10D. In other words, the seat plate lower surface 4L functions as a guide surface for guiding movement of the fingers, thereby improving operability of the lever 10D.

Furthermore, the wire structure 11 is constituted by the outer tube 11A, the inner wire 11B, the first wire engaging end 11F, and the second wire engaging end 11S. The wire structure 11 is a single unit. The wire structure 11 can be removed from the chair 100 simply by removing the operation unit cover 13, removing the first wire engaging end 11F from the wire support portion 10C, and removing the second wire engaging end 11S from the pressing engagement portion 12C. Therefore, replacement work of the wire structure 11 can be easily performed.

Furthermore, the operation mechanism 5 includes the lever 10D that is rotatable in the rotation operation direction 85. Therefore, a size of the operation mechanism 5 that rotates the lever 10D increases in the front-rear directions FD and BD and the left-right directions RD and LD, but decreases in the vertical directions UD and DD. That is, there is no need to increase a size of the operation mechanism 5 in the vertical directions UD and DD of the seat main body 4, which is a plate-shaped member, and a thickness of the seat main body 4 can be reduced.

While preferred embodiments of the invention have been described, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

Furthermore, in the above-described embodiment, the chair 100 without armrests has been described. If the chair 100 includes armrests, the armrests extend in the upward direction UD from both side portions of the lower side of the seat 1. Elbows and forearms of the occupant are placed on the armrests.

REFERENCE SIGNS LIST

1 Seat
2 Backrest
3 Support structure
4 Seat main body
5 Operation mechanism
100 Chair

The invention claimed is:

1. A chair comprising:
a seat;
a backrest tiltable with respect to the seat; and
a support structure supporting the seat and the backrest, wherein
the backrest includes:
an arm portion supported by the support structure; and
a back support portion positioned above the arm portion in a vertical direction and supported by the arm portion, and
the support structure includes:
a first shaft portion extending in a first direction intersecting the vertical direction and rotatably supporting the seat;
a second shaft portion extending in the first direction, positioned behind the first shaft portion in a second direction, and rotatably supporting the seat, wherein the second direction intersects the vertical direction and the first direction;
a third shaft portion positioned below the first shaft portion in the vertical direction, extending in the first direction, and rotatably supporting the arm portion;
a fourth shaft portion positioned behind the third shaft portion in the second direction and extending in the first direction;
a support base supporting the third shaft portion and the fourth shaft portion;
an arm support portion rotatably supported by each of the first shaft portion and the third shaft portion, tiltable with respect to the second direction in conjunction with rotation of the arm portion around the third shaft portion, and supporting the arm portion; and
a support link including a first link support portion rotatably supported by the second shaft portion and a second link support portion rotatably supported by the fourth shaft portion, and positioned behind the first shaft portion and the third shaft portion in the second direction.

2. The chair according to claim 1, wherein
the backrest is tiltable with respect to the seat within a tilt range between a front limit position and a rear limit position in the second direction, and
if the backrest is at the front limit position, the support link stands upright in the vertical direction, or the support link is inclined with respect to the vertical direction such that the second shaft portion is positioned forward of the fourth shaft portion in the second direction.

3. The chair according to claim 2, wherein
a first distance between the first shaft portion and the third shaft portion is greater than a second distance between the second shaft portion and the fourth shaft portion.

4. The chair according to claim 3, wherein
a position of the second shaft portion is higher than a position of the third shaft portion in the vertical direction.

5. The chair according to claim 1, wherein
the seat has a lower surface in the vertical direction and a recessed portion provided on the lower surface, and
the first shaft portion and the second shaft portion are housed inside the recessed portion.

6. The chair according to claim 5, wherein
the seat includes a seat main body having the lower surface on which the recessed portion is formed,
the support structure includes a seat support member housed inside the recessed portion,
the seat support member supports the first shaft portion and the second shaft portion, and
the seat support member overlaps the seat main body when viewed in the first direction.

7. The chair according to claim 1, wherein
the arm support portion is a support connector attachable to and detachable from the arm portion.

8. The chair according to claim 7, wherein
the support connector includes:
a first connector support portion rotatably supported by the first shaft portion;
a second connector support portion rotatably supported by the third shaft portion; and
a notch portion provided between the first connector support portion and the second connector support portion and formed in a substantially U shape when viewed in the first direction.

* * * * *